US012460402B2

(12) United States Patent
Young et al.

(10) Patent No.: US 12,460,402 B2
(45) Date of Patent: Nov. 4, 2025

(54) FAST INSTALLATION CAP AND DRAIN

(71) Applicant: Blucher Metal A/S, Vildbjerg (DK)

(72) Inventors: Stuart Gordon Young, Cheshire (GB); Gary A. Hodge, Rutherfordton, NC (US)

(73) Assignee: Blucher Metal A/S, Vildbjerg (DK)

( * ) Notice: Subject to any disclaimer, the term of this patent is extended or adjusted under 35 U.S.C. 154(b) by 333 days.

(21) Appl. No.: 17/837,402

(22) Filed: Jun. 10, 2022

(65) Prior Publication Data

US 2022/0298772 A1 Sep. 22, 2022

Related U.S. Application Data

(63) Continuation-in-part of application No. 16/975,617, filed as application No. PCT/DK2019/050074 on Feb. 26, 2019, now Pat. No. 11,384,523.

(30) Foreign Application Priority Data

Feb. 26, 2018 (DK) ..... 201870126

(51) Int. Cl.
*E03F 5/04* (2006.01)
*E03F 5/14* (2006.01)

(52) U.S. Cl.
CPC ..... *E03F 5/041* (2013.01); *E03F 5/0407* (2013.01); *E03F 5/14* (2013.01)

(58) Field of Classification Search
None
See application file for complete search history.

(56) References Cited

U.S. PATENT DOCUMENTS 1,669,586 A * 5/1928 Boosey ..... E03F 5/0407 137/577
1,766,621 A * 6/1930 Fleming ..... E03F 5/0409 249/83

(Continued)

FOREIGN PATENT DOCUMENTS

DE 9413695 U1 10/1994
EP 1464768 A2 10/2004

(Continued)

OTHER PUBLICATIONS

International Search Report From Corresponding International Patent Application No. PCT/DK2019/050047, Mailed Apr. 24, 2019, 7 Pages.

(Continued)

*Primary Examiner* — Robert J Popovics
(74) *Attorney, Agent, or Firm* — Day Pitney LLP; George Chaclas; Christopher J. Head

(57) ABSTRACT

An elongated floor cleanout assembly includes a drain assembly. The drain assembly has a body assembly and a grating cover secured to the body assembly by at least one screw. The drain assembly also has a cap enclosing the drain assembly and secured to the grating cover by the at least one screw. The cap defines at least one slit having an arcuate portion and an end. The at least one screw is captured in the arcuate portion and the cap can be rotated to selectively allow the at least one screw to freely pass through the end for removal of the cap without removing the at least one screw.

10 Claims, 18 Drawing Sheets

(56) References Cited

U.S. PATENT DOCUMENTS 1,792,345 A * 2/1931 Williams ..... E03F 5/0407 285/391
1,815,683 A 7/1931 Sherman
1,951,645 A * 3/1934 Boosey ..... E03F 5/0407 220/86.1
2,508,044 A * 5/1950 Seddon ..... B28B 21/74 52/220.8
2,749,999 A * 6/1956 Schmid ..... E03F 5/0409 285/31
2,889,928 A * 6/1959 Sisk ..... E03F 5/0407 210/163
3,173,443 A * 3/1965 Saville ..... E04F 19/08 52/220.8
3,285,289 A * 11/1966 Titus ..... E03F 5/021 285/302
3,362,425 A * 1/1968 Morris ..... E03F 5/02 404/26
3,420,552 A * 1/1969 Mork ..... E03F 5/0408 4/288
3,445,973 A * 5/1969 Stone ..... E03F 7/02 4/293
3,951,172 A * 4/1976 Flegel ..... F16L 55/115 220/259.4
4,067,072 A * 1/1978 Izzi ..... E03F 5/0407 285/12
4,092,745 A * 6/1978 Oropallo ..... E03F 5/0408 4/292
4,146,939 A * 4/1979 Izzi ..... E03C 1/26 4/286
4,233,697 A * 11/1980 Cornwall ..... E03D 11/16 4/293
4,261,824 A * 4/1981 Cuschera ..... E03F 5/06 210/164
4,360,041 A * 11/1982 Hagan ..... F16L 45/00 138/96 T
4,502,166 A * 3/1985 Brown, Sr. ..... E03D 11/16 4/252.5
4,505,814 A * 3/1985 Marshall ..... E04D 13/0409 404/26
4,614,065 A * 9/1986 Papp ..... E03C 1/12 52/220.8
4,620,330 A * 11/1986 Izzi, Sr. ..... F16L 25/14 285/915
4,694,513 A * 9/1987 Kiziah ..... E03F 5/0408 285/136.1
4,825,477 A * 5/1989 Aranda ..... E03C 1/264 4/293
4,879,771 A * 11/1989 Piskula ..... E03F 7/00 4/256.1
4,883,590 A * 11/1989 Papp ..... E03F 5/0407 210/232
4,967,422 A * 11/1990 Novak ..... E03D 11/16 138/96 T
5,244,040 A 9/1993 Pecue
5,265,752 A 11/1993 Olson et al.
5,341,523 A * 8/1994 Barnes ..... E04H 4/12 4/689
5,372,715 A * 12/1994 Maggard ..... E03F 5/0409 4/290
5,618,416 A * 4/1997 Haefner ..... E04D 13/0409 210/166
5,921,282 A * 7/1999 Castillo ..... F16L 57/00 220/780
6,076,559 A * 6/2000 Castillo ..... F16L 55/11 220/784
6,085,362 A * 7/2000 Huber ..... E03D 11/16 4/252.4
6,101,774 A * 8/2000 Heil ..... E04G 15/061 52/220.8
6,381,775 B1 * 5/2002 Sondrup ..... F16L 27/053 210/163
6,568,021 B1 5/2003 Wood
6,668,417 B1 12/2003 Slattery
6,766,545 B2 * 7/2004 Hodges ..... E03C 1/20 4/679
7,624,759 B1 * 12/2009 Ismert ..... E03C 1/22 4/293
7,699,981 B2 * 4/2010 Ledford ..... E02D 29/14 52/302.1
7,735,512 B1 * 6/2010 Ismert ..... E04G 15/061 137/362
7,739,757 B2 * 6/2010 Witt ..... E03F 5/0408 4/612
7,964,095 B1 * 6/2011 Graybeal ..... E03F 5/04 52/302.1
7,992,236 B2 * 8/2011 Degooyer ..... E03F 5/0408 4/652
8,043,497 B2 * 10/2011 Silverstein ..... E03F 5/06 210/232
8,196,229 B1 * 6/2012 Hickok ..... E03F 5/041 4/288
8,347,424 B2 * 1/2013 Wroblewski ..... E04G 23/02 52/302.1
8,347,906 B1 * 1/2013 Ismert ..... E04G 15/061 4/293
8,658,033 B2 * 2/2014 Farkas ..... E03C 1/122 210/163
8,813,273 B2 * 8/2014 Stimpson ..... E03C 1/22 4/293
8,881,490 B2 * 11/2014 Wroblewski ..... E03F 5/0407 52/302.1
8,925,123 B2 * 1/2015 DeGooyer ..... E03F 5/0408 4/652
9,175,797 B1 * 11/2015 Behoteguy ..... E03F 5/0404
9,267,252 B1 * 2/2016 Adler ..... E02D 29/14
9,322,157 B1 * 4/2016 Ismert ..... F16L 37/248
9,366,017 B2 * 6/2016 Cook ..... E03F 5/0408
9,428,900 B2 * 8/2016 Wroblewski ..... E03F 5/0407
9,453,331 B1 * 9/2016 Buffington ..... E03F 5/041
9,551,141 B2 * 1/2017 Clinton ..... F16L 57/005
9,651,372 B1 * 5/2017 Lopez ..... G01C 9/24
9,869,081 B1 * 1/2018 Pardo, Jr. ..... F16L 55/1157
10,041,242 B2 * 8/2018 Yssel ..... E03D 11/16
10,113,303 B2 * 10/2018 Mardian ..... E03F 5/06
10,167,622 B2 * 1/2019 Brooks ..... E03F 5/06
10,190,305 B2 * 1/2019 Howson ..... E03F 5/0408
10,370,841 B2 * 8/2019 Huber ..... E03F 5/0407
10,378,196 B2 * 8/2019 Huber ..... E03F 5/0407
10,487,492 B2 * 11/2019 Boersma ..... E03C 1/26
10,683,654 B2 * 6/2020 Priester ..... E03F 5/0407
10,704,248 B2 * 7/2020 Howson ..... E03F 5/0408
10,711,447 B2 * 7/2020 Say ..... E03F 5/0407
D897,503 S * 9/2020 Hodge ..... D23/261
11,047,126 B1 * 6/2021 Whiteside ..... E03F 5/06
11,078,658 B2 * 8/2021 Say ..... E03F 5/0411
11,118,340 B2 * 9/2021 Huber ..... E03F 5/0407
11,268,271 B2 * 3/2022 Say ..... E03F 5/0411
11,384,523 B2 * 7/2022 Young ..... E03F 5/041
11,391,026 B2 * 7/2022 Glazar ..... E03C 1/262
11,566,407 B2 * 1/2023 Jones, Jr. ..... F16J 15/3284
11,591,787 B2 * 2/2023 Say ..... E03F 5/0407
11,828,055 B2 * 11/2023 Say ..... E03F 5/0407
11,920,350 B2 * 3/2024 Iftissen ..... E04D 13/0409
11,946,241 B2 * 4/2024 Lorkowski ..... E03F 5/0409
11,982,097 B2 * 5/2024 Powers ..... E03F 5/04
12,012,742 B2 * 6/2024 Henry ..... B01D 29/35
12,018,489 B2 * 6/2024 Majocka ..... E04D 13/0409
12,077,955 B2 * 9/2024 Noonan ..... E03F 5/0407
12,366,063 B2 * 7/2025 Say ..... E03F 5/0407
2003/0159211 A1 * 8/2003 Hodges ..... E03C 1/20 4/679
2005/0138722 A1 6/2005 Humber
2007/0034577 A1 * 2/2007 Bayard ..... E03F 5/06 210/163
2007/0246116 A1 10/2007 Peak et al.
2008/0290012 A1 * 11/2008 Shih ..... E03F 5/0407 210/163
2009/0113621 A1 * 5/2009 DeGooyer ..... E03F 5/0408 4/679

(56) References Cited

U.S. PATENT DOCUMENTS

2009/0223884 A1* 9/2009 Wroblewski ..... E03F 5/0407 210/163
2010/0024107 A1* 2/2010 Stimpson ..... E03C 1/22 4/293
2011/0126935 A1* 6/2011 Zeyfang ..... F16L 23/003 138/96 R
2012/0025517 A1* 2/2012 Majocka ..... E03F 5/041 285/27
2012/0036629 A1* 2/2012 Cook ..... E03F 5/0407 4/613
2012/0036697 A1* 2/2012 Cook ..... E03F 5/0407 29/428
2012/0234430 A1* 9/2012 Zeyfang ..... F16L 23/003 138/96 R
2012/0240319 A1* 9/2012 Yssel ..... E03D 11/16 4/252.1
2013/0186036 A1* 7/2013 Wroblewski ..... E04G 23/02 52/745.05
2013/0193042 A1* 8/2013 Hull ..... E03F 5/0409 210/164
2014/0116527 A1* 5/2014 Wroblewski ..... E03F 5/0407 137/15.01
2014/0138297 A1* 5/2014 Hull ..... E03F 5/0407 210/164
2014/0157514 A1* 6/2014 Cook ..... E03F 5/0408 4/679
2015/0121782 A1* 5/2015 McConnell ..... H02G 3/22 52/232
2016/0333565 A1* 11/2016 Clinton ..... E03F 5/041
2017/0130442 A1* 5/2017 Brooks ..... E03F 5/0407
2017/0159278 A1* 6/2017 Huber ..... E03F 5/0407
2017/0247872 A1* 8/2017 Huber ..... E03F 5/0407
2018/0073237 A1* 3/2018 Say ..... E03F 5/0407
2019/0119896 A1* 4/2019 Priester ..... E03F 5/0407
2019/0316334 A1* 10/2019 Larson ..... E03F 5/0408
2019/0316341 A1* 10/2019 Say ..... E04G 15/061
2019/0383019 A1* 12/2019 Hetzler ..... E04D 13/0409
2020/0157790 A1* 5/2020 English ..... E03C 1/264
2020/0340230 A1* 10/2020 Say ..... E03F 5/0407
2021/0010254 A1* 1/2021 Young ..... E03F 5/041
2021/0180307 A1* 6/2021 Whiteside ..... E03F 5/041
2021/0238839 A1* 8/2021 Say ..... E03F 5/041
2021/0285196 A1* 9/2021 Glazar ..... E03C 1/262
2021/0317666 A1* 10/2021 Majocka ..... E04D 13/0409
2021/0355670 A1* 11/2021 Say ..... E03F 5/0407
2022/0120086 A1* 4/2022 Majocka ..... E04D 13/0409
2022/0298772 A1* 9/2022 Young ..... E03F 5/0411
2023/0102254 A1* 3/2023 Noonan ..... E03F 5/0407 52/747.11
2023/0228087 A1* 7/2023 Majocka ..... E04D 13/0409 285/42
2023/0250624 A1* 8/2023 Lorkowski ..... E03F 5/0409
2023/0279654 A1* 9/2023 Say ..... E03F 5/041 210/163
2023/0313518 A1* 10/2023 Zhang ..... E03F 5/0407 52/198
2024/0044122 A1* 2/2024 Say ..... E03F 5/0411
2024/0301697 A1* 9/2024 Majocka ..... E04D 13/0409

FOREIGN PATENT DOCUMENTS

EP 1956153 A1 8/2008
EP 3031990 A1 6/2016
EP 3759287 B1 * 6/2023 ..... E04D 13/0409
KR 20040104211 A 12/2004
WO WO-2019161874 A1 * 8/2019 ..... E04D 13/04

OTHER PUBLICATIONS

Search Report For Corresponding Danish Patent Application No. PA 2018 70126, Mailed Jan. 8, 2018, 3 Pages.

Supplementary European Search Report Issued in Corresponding European Patent Application No. 19757003, Oct. 21, 2021, 2 Pages.

* cited by examiner

FAST INSTALLATION CAP AND DRAIN

CROSS-REFERENCE TO RELATED APPLICATIONS

This application is a continuation-in-part of and claims the benefit and priority of U.S. patent application Ser. No. 16/975,617 filed Aug. 25, 2020 (now U.S. Pat. No. 11,384,523 issued on Jul. 12, 2022), which is a National Stage Entry of International Application No. PCT/DK2019/050074 filed Feb. 26, 2019, which claims the benefit and priority of Danish Patent Application No. PA201870126 filed Feb. 26, 2018, each of which is incorporated herein by reference.

FIELD OF THE DISCLOSURE

The present disclosure relates to a combination of a cover plate and a drain, preferably a floor or roof drain, and more specifically to an adjustable and/or fast installation drain.

BACKGROUND OF THE DISCLOSURE

When mounting a drain in a plane surface, it is necessary to adjust the height of the drain to accord with a height of the plane surface and a height of supporting concrete to be spread around the drain. In the current state of the art, contractors must estimate the height of concrete that should surround the drain, and in turn, adjust the plumbing height prior to pouring the concrete. Adjusting the plumbing height to cooperate with a fixed height drain is daunting, time consuming and may introduce leaks in a plumbing fixture. The drain may also become contaminated or damaged during the installation process which can permanently reduce performance or require time consuming cleaning.

SUMMARY

In view of the above such, there is a need for a quickly and easily adjustable height drain. Moreover, there is a need for a drain that is axially adjustable pre- and post-concrete pour to ensure proper leveling between the drain and surrounding concrete. Furthermore, there is a need to prevent injury which may arise with an uneven floor. The subject disclosure describes a fast installation cap and drain serving as a water cleanout that is completely adjustable, providing maximum efficiency and accuracy during installation. That is, the fast installation cap and drain is designed for pre- and post-concrete pour adjustment. Further, the drain preferably has protective features that do not interfere with installation but can be quickly and easily removed.

The design of the fast installation cap and drain makes it easy for contractors to perform a level set of a floor drain on a standard, finished, or tiled floor. The fast installation cap and drain comes pre-assembled and ready to install.

The subject technology is directed to an elongated floor cleanout assembly including a drain assembly. The drain assembly has a body assembly and a grating cover secured to the body assembly by at least one screw. The elongated floor cleanout also has a cap enclosing the drain assembly and secured to the grating cover by the at least one screw. The cap defines at least one slit having an arcuate portion and an end. The at least one screw is captured in the arcuate portion and the cap can be rotated to selectively allow the at least one screw to freely pass through the end for removal of the cap without removing the at least one screw.

In another implementation, the cap may form opposing notches for receiving a tool to rotate the cap. The cap may include a top surface with at least one recessed portion. The recessed portion forms the at least one slit. The at least one recessed portion includes a sidewall and the sidewall forms the end.

The subject technology is also directed to an elongated floor cleanout assembly including a cylindrical drain body assembly defining a threaded opening having an outlet configured to couple to a pipe. The elongated floor cleanout assembly includes a tubular housing defining a threaded passage aligned with the threaded opening. The tubular housing includes outer threads for coupling to the threaded opening to selectively adjust axial extension of the tubular housing out of the cylindrical body assembly before creation of a sub-floor around the elongated floor cleanout assembly. The elongated floor cleanout assembly includes a shank having a throughbore defining an inlet. The shank includes outer threads for coupling to the threaded passage to selectively adjust axial extension of the shank out of the tubular housing after creation of a sub-floor around the elongated floor cleanout assembly.

In another implementation, the elongated floor cleanout assembly may include a cover and at least one screw securing the cover to the shank. The elongated floor cleanout assembly may include a cap secured to the cover by the at least one screw. The cap may define at least one slit having an arcuate portion and an enlarged end. The at least one screw may be captured in the arcuate portion and the cap can be rotated to selectively allow the at least one screw to freely pass through the enlarged end for removal of the cap without removing the at least one screw. The cap may form opposing notches for receiving a tool to rotate the cap. The cap may include a top surface with at least one recessed portion. The at least one recessed portion may form the at least one slit. The at least one recessed portion may include a sidewall and the sidewall may form the enlarged end. The cap may be circular and include a central level.

A protector may be mounted to the cap to prevent debris from collecting on the cap and provides indicia related to instructions. The protector may be glued to the cap and frangible.

The subject technology is directed to an adjustable floor cleanout assembly including a cylindrical drain body assembly defining an opening and having an outlet configured to couple to a pipe. The adjustable floor cleanout assembly includes a tubular housing defining a passage aligned with the opening. The tubular housing is configured to couple to the opening. The adjustable floor cleanout assembly includes a shank having a throughbore defining an inlet. The shank is configured to couple to the passage. In a pre-concrete pour phase, the tubular housing is adjusted to a first height via axial extension out of the cylindrical drain body assembly.

In another implementation, in a post-concrete pour phase, the shank may be adjusted to a second height via axial extension out of the tubular housing. The adjustable floor cleanout assembly may include a cover and at least one screw securing the cover to the shank. The cover may be configured to enclose the shank and prevent debris from entering the cylindrical drain body assembly. The adjustable floor cleanout assembly may include a cap secured to the cover by the at least one screw. The cap may define at least one slit having an arcuate portion and an enlarged end. The at least one screw may be captured in the arcuate portion and the cap can be rotated to selectively allow the at least one screw to freely pass through the enlarged end for removal of the cap without removing the at least one screw.

It should be appreciated that the subject technology can be implemented and utilized in numerous ways, including without limitation as a process, an apparatus, a system, a device, a method for applications now known and later developed. These and other unique features of the system disclosed herein will become more readily apparent from the following description and the accompanying drawings.

DESCRIPTION OF THE DRAWINGS

Various aspects of the present disclosure are discussed herein with reference to the accompanying Figures. It will be appreciated that for simplicity and clarity of illustration, elements shown in the drawings have not necessarily been drawn accurately or to scale. For example, the dimensions of some of the elements can be exaggerated relative to other elements for clarity or several physical components can be included in one functional block or element. Further, where considered appropriate, reference numerals can be repeated among the drawings to indicate corresponding or analogous elements. For purposes of clarity, however, not every component can be labeled in every drawing. The Figures are provided for the purposes of illustration and explanation and are not intended as a definition of the limits of the disclosure.

DETAILED DESCRIPTION OF THE PREFERRED EMBODIMENTS

Figure 1:
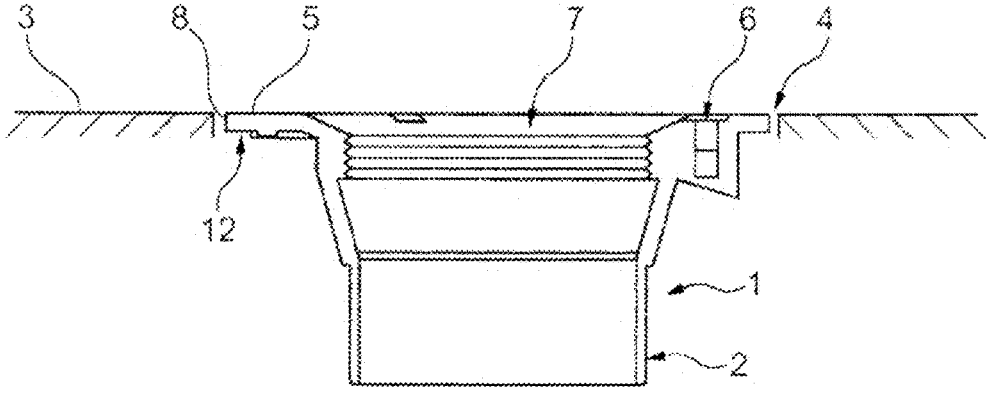
FIG. 1 shows a cross-sectional view of a drain according to the subject disclosure.

The subject technology overcomes many of the prior art problems associated with drain assemblies. The advantages, and other features of the technology disclosed herein, will become more readily apparent to those having ordinary skill in the art from the following detailed description of certain exemplary embodiments taken in combination with the drawings and wherein like reference numerals identify similar structural elements. It should be noted that directional indications such as vertical, horizontal, upward, downward, right, left and the like, are used with respect to the figures and not meant in a limiting manner.

FIG. 1 illustrates a drain 1 comprising a lower part 2, which is intended for connection with piping below the surface 3 in which the drain 2 is arranged. The drain comprises an upper end 4 having a flange 5 which is preferably a circumferential flange. The drain comprises a hole 6 which is intended for use with a screw used to fasten a grating (not distinctly shown) which is used to cover an upwardly opening 7 of the drain 1.

The flange 5 has a thickness 8 which is adjusted to the specific cap as explained later. It is noted that there will always be an additional layer on top of a first pour which is made by the main contractor. The finish of a floor will be effected by a floor contractor. Therefore a space will exists between the drain and the floor made by the first contractor and the space makes it possible to provide tabs for a cap as explained later. The space will be covered by the floor contractor.

When the floor contractor has finished the work, the tabs of the cap covering the drain will be embedded in the finishing layer of the floor.

The drain can be produced from different materials. The drain can be made from plastic, metal cast iron, concrete, clay or other materials which are found suitable for manufacture of a drain.

Figure 2:
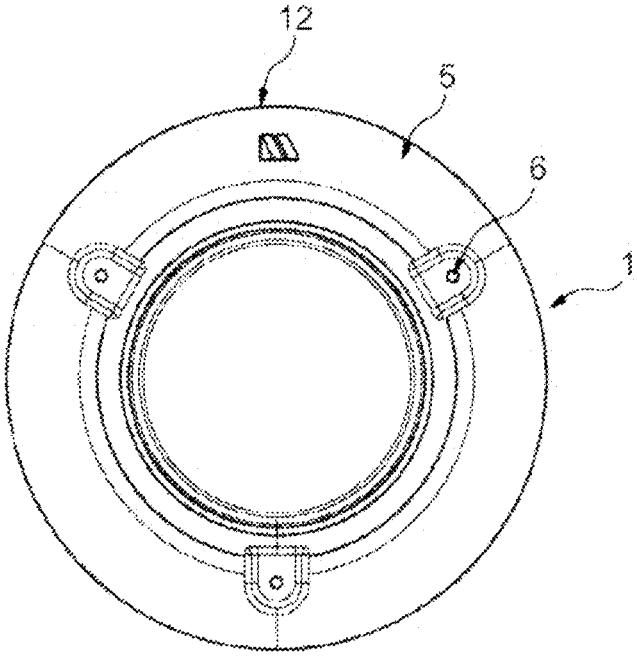
FIG. 2 shows an overhead view of the drain of FIG. 1.

In FIG. 2, it is seen that the flange 5 is a circular flange. However, the flange might have other configurations and the flange does not necessarily need to be a circumferential flange 5.

Figure 3:
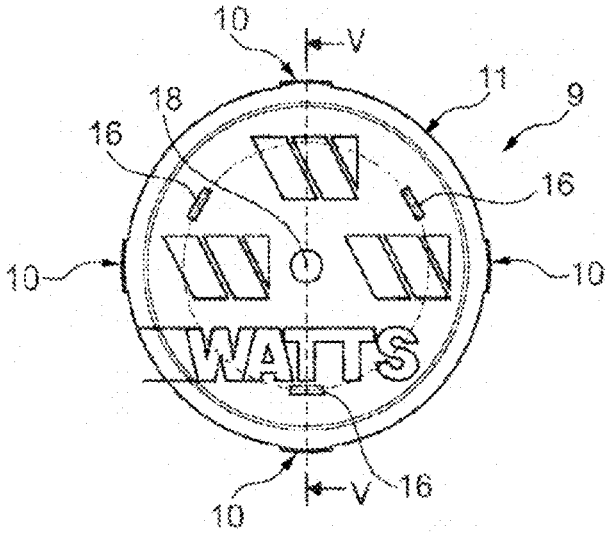
FIG. 3 shows an overhead view of a cap intended for use in combination with the drain of FIG. 1.

FIG. 3 illustrates a cap 9 which is used for covering the opening 7 of the drain 1. The cap 9 is provided with first locking means which are provided in form of locking tabs 10 which are arranged along a circumferential edge 11 of the cap 9. The locking tabs 10 cooperate with second locking means in form of the edge area 12 of the flange 5. As more clearly illustrated in FIGS. 4-6 one can see that the locking tabs 10 comprise a leg portion 25 connecting a wedge shaped outer end 13 with the plate portion 14 of the cap 9. The leg portion 25 is flexible and thereby provides the possibility that the locking tabs 10 may be pressed down over the flange 5 whereby the outer end 13 will enter into engagement with the edge area 12 at the downwardly orientated surface of the flange 5. Hereby the cap will be connected to the drain.

Figure 6:
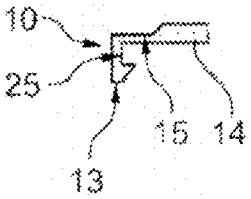
FIG. 6 shows an enlarged portion of tabs depicted in FIG. 5.

As most clearly illustrated in FIG. 6, the cap comprises a weakening line 15 connecting the locking tab 10 with the plate portion 14. Accordingly, the connection between the cap and drain is releasable. The locking tabs 10 will break off when the cap is removed from the drain as the lower end 13 will have engagement with the downwardly orientated surface of the flange 5 and therefore a breaking will occur along the weakening line 15.

Figure 9:
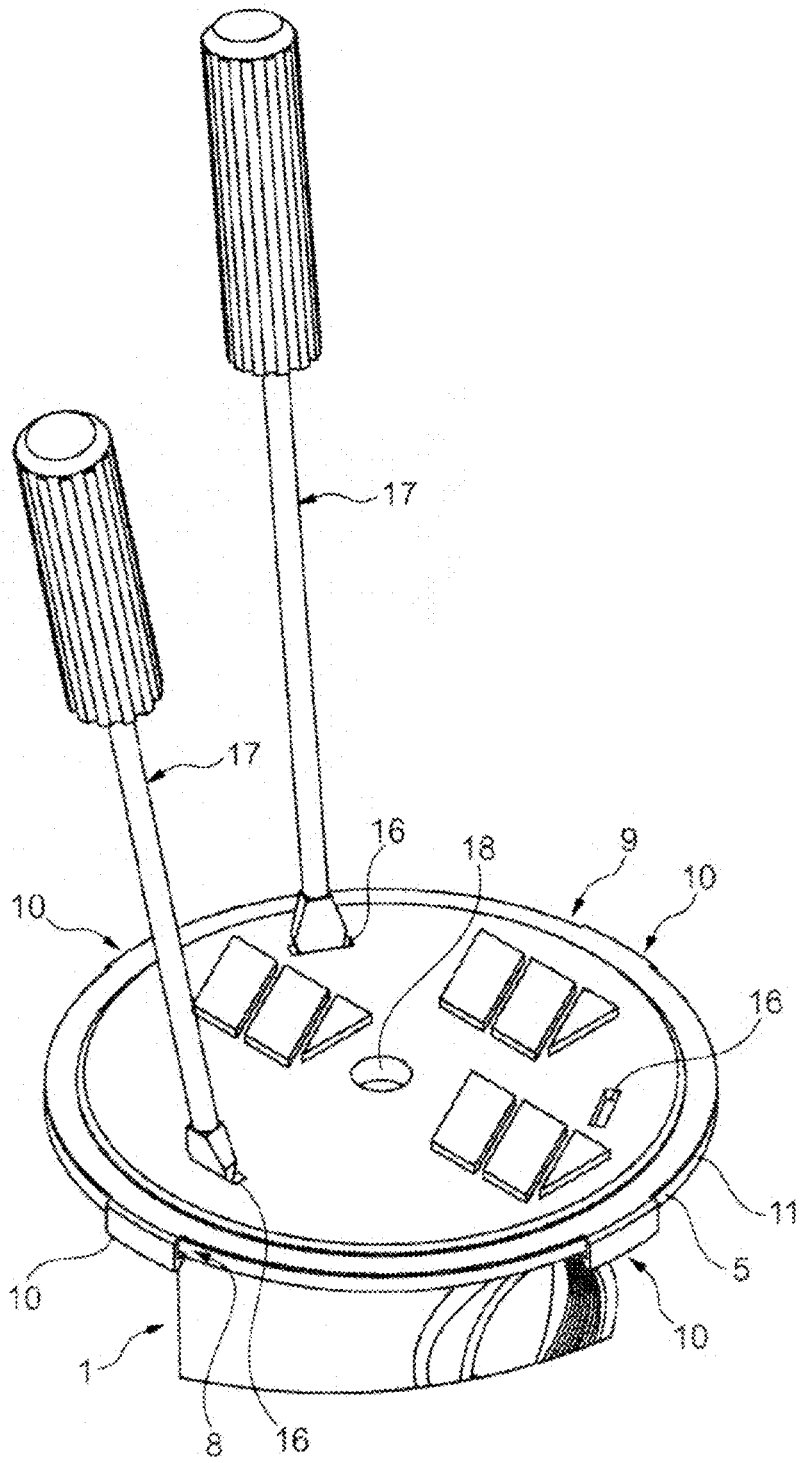
FIG. 9 illustrates the cap of FIGS. 3-8 including a screw driver, operative to remove the cap from the drain of FIGS. 1 and 2.

The cap 9 is provided with openings 16. Each opening 16 may be slit-formed and intended for the engagement with a screw driver 17 as illustrated in FIG. 9. The screw driver is used for removing the cap 9 from the drain 1.

The cap comprises a hollow 18. The hollow 18 is intended to contain a level means 19 (see description below) which is intended for determining the orientation of the cap and thereby also the orientation of the drain 1 in relation to a horizontal plane or a vertical. The level means 19 may be fixed in the hollow 18 in different ways. The fixation is intended to be fixed and not removable in order to secure that the level means always will have a fixed orientation in relation to the cap 9.

The level means may be cast into the cap during production of the cap or may be attached in the hollow by gluing after the production of the cap with the hollow 18.

Figure 7:
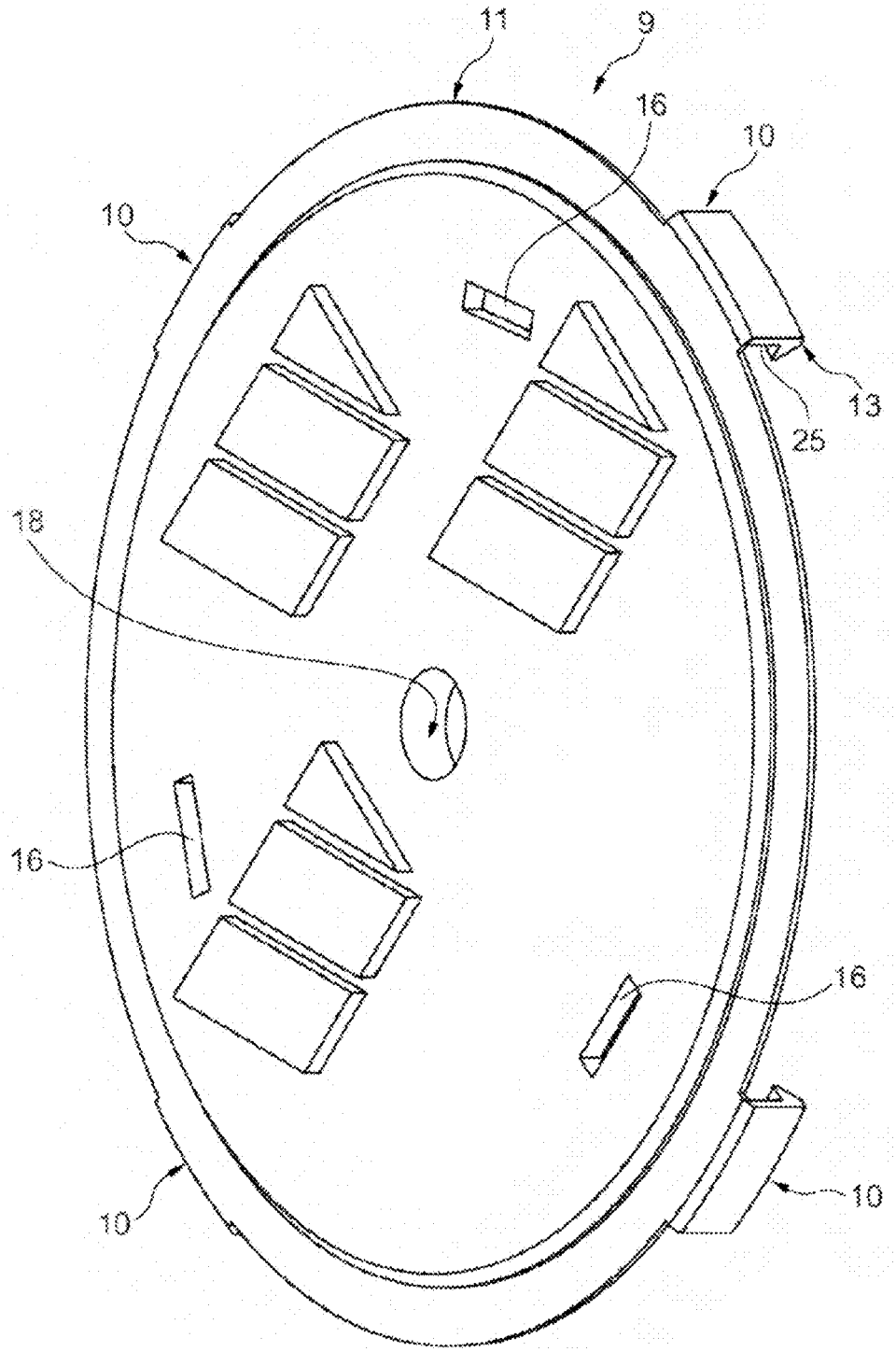
FIG. 7 illustrates an overhead perspective view of the cap of FIGS. 3-6.
Figure 8:
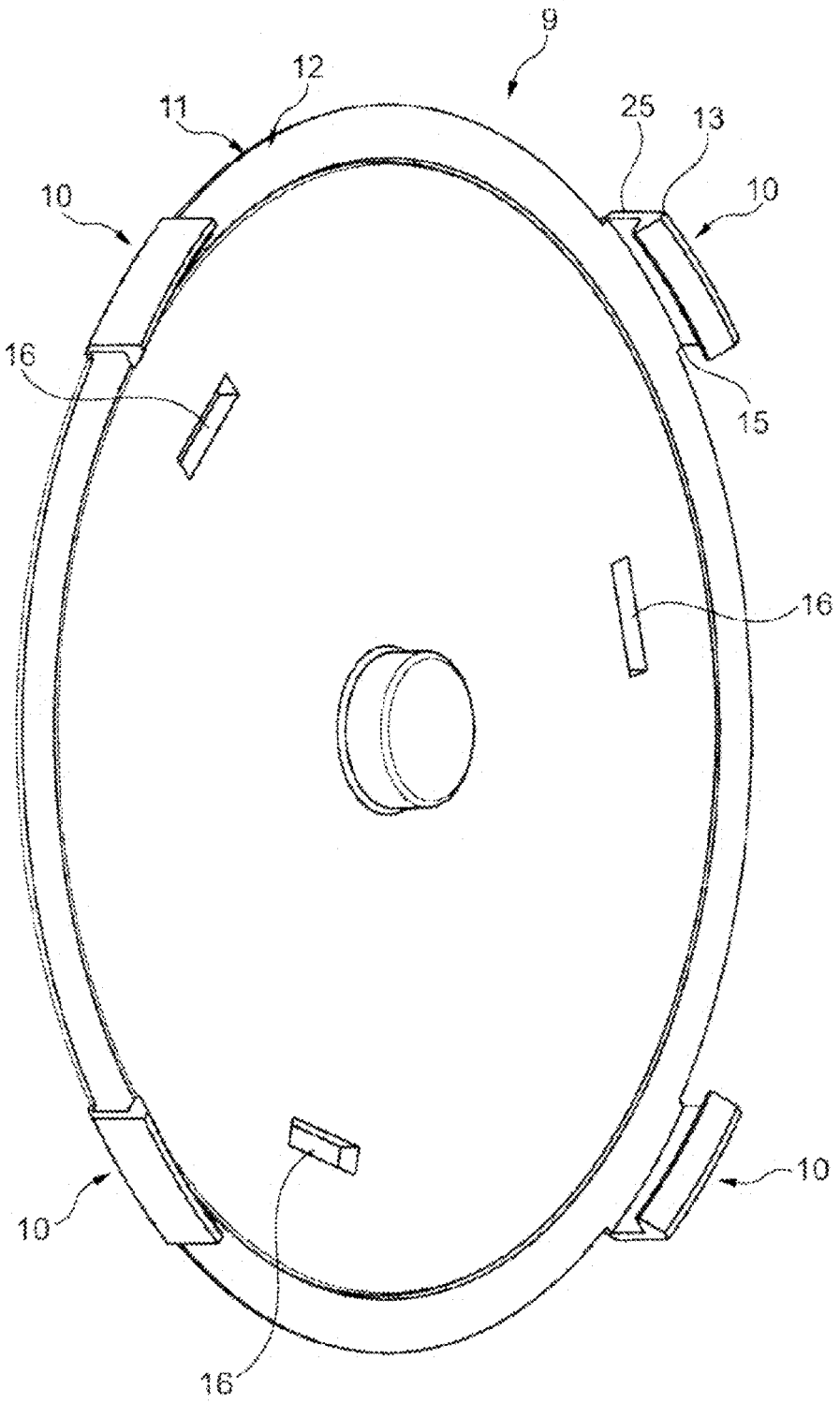
FIG. 8 illustrates a bottom perspective view of the cap illustrated in FIG. 7.

FIGS. 7 and 8 illustrate an enlarged perspective view of the cap as seen from above and from below. Reference numbers are inserted in order to more clearly indicate the elements already explained in connection with FIGS. 3-6.

FIG. 9 illustrates a situation in which screw drivers 17 are inserted into the openings 16. When a bending force is exerted with the screw driver there will easily be a tilting of the cap which causes the breaking of the locking tabs 10 along the weakening line 15.

Figure 10:
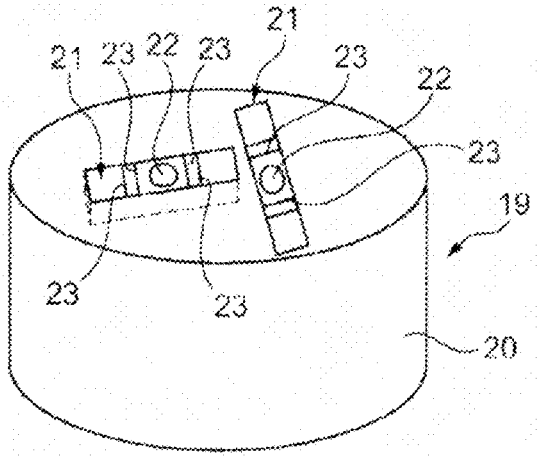
FIG. 10 shows an embodiment for level means used in the cap of FIGS. 3-8.
Figure 11:
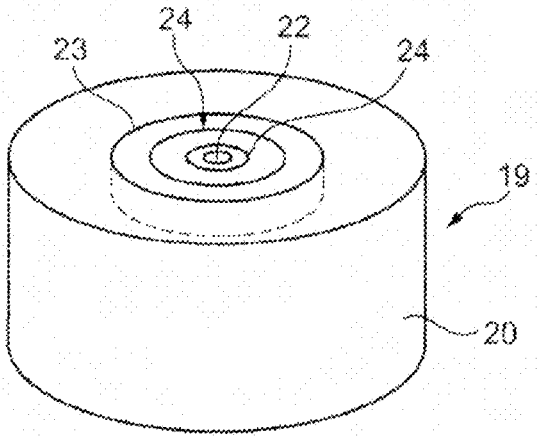
FIG. 11 shows a further embodiment for level means used in the cap of FIG. 3-8.

FIGS. 10-11 illustrate embodiments for level means 19. The level means 19 comprises a housing 20 which is intended for being fixed in the hollow 18 in the cap 9.

In FIG. 10, the level means 19 comprises two perpendicularly arranged tubular spirit levels 21. Each of the levels comprises a bubble 22 and graduation 23 for visual indication of inclination.

FIG. 11 illustrates a bull's eye spirit level 24. This bull's eye spirit level also comprises a bubble 22 and graduations 23 for visual indication of an inclination.

Figure 12:
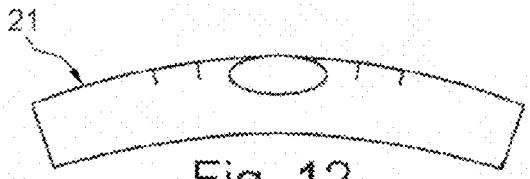
FIG. 12 shows an embodiment of the level means of FIG. 10-11, specifically a bubble housing.

FIG. 12 illustrates a straight tubular spirit level 21 having a uniform diameter, however, having a curvature.

Figure 13:
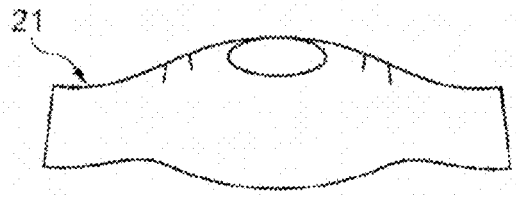
FIG. 13 shows a further embodiment of the level means of FIG. 10-11, specifically a bubble housing.

FIG. 13 illustrates an embodiment with a straight tubular spirit level 21 in which the central part is increased compared to the diameter of the outer ends of the tubular spirit level.

The embodiments of FIGS. 12 and 13 may be used in the level means 19 illustrated in FIG. 10.

Figure 14:
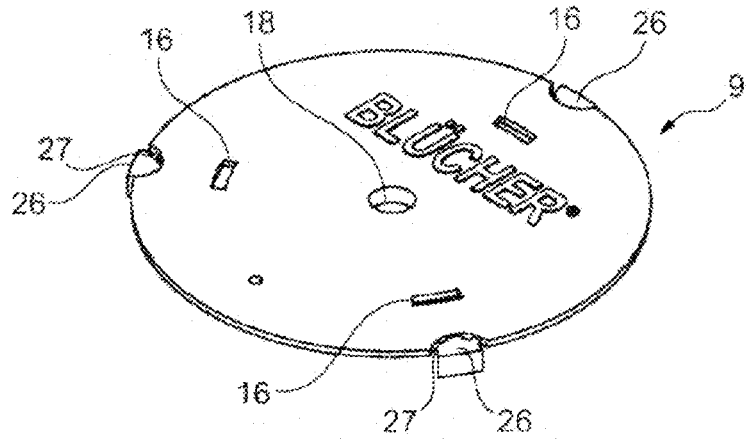
FIGS. 14-17 show a further embodiments of the cap of FIGS. 3-8.

FIG. 14 illustrates a cap 9 having openings 16 for a screw driver and a hollow 18 for containing a level means.

This embodiment comprises first locking means in the form of tabs 26 which through weakening lines 27 are connected to the main part of the cap 9. The tabs will have a part arranged to engage under the flange of the drain.

When inserting a screw driver in the opening 16 and exerting a force, the tabs 26 will break off by a breaking at the weakening line. The tab 26 will have a form as explained with the locking tabs 10 above.

Figure 15:
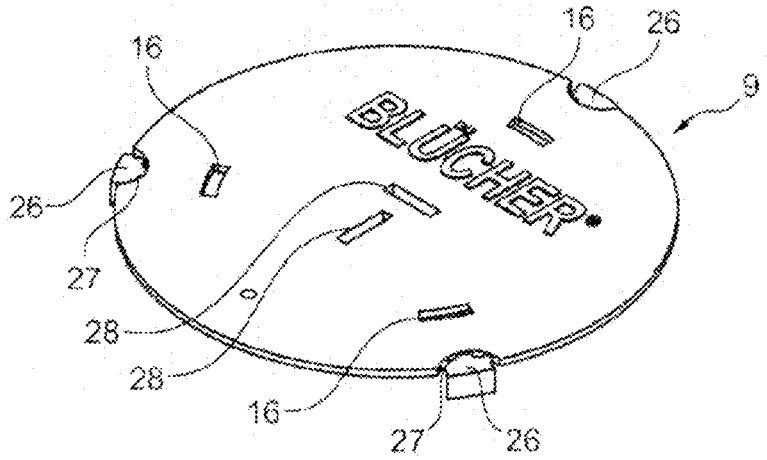

FIG. 15 corresponds to FIG. 14. The cap according to FIG. 15 is provided with two rectilinear hollows 28 instead of the circular hollow 18 illustrated in FIG. 14. The hollows 28 are provided directly in the cap 19 and are intended for containing tubular spirit level 21 of the type illustrated in FIG. 12 or 13.

Figure 16:
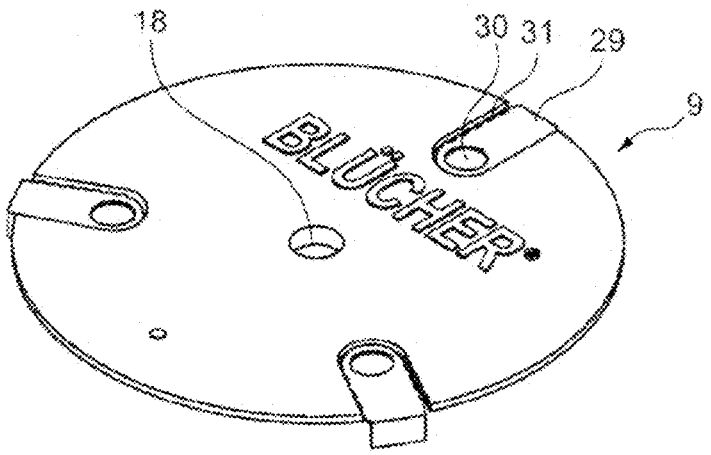

FIG. 16 illustrates a further embodiment for a cap 9. The cap 9 is provided with first locking means in form of tabs 29. The tabs will have a part arranged to engage under the flange of the drain. The tabs are provided with a pull eye 30 in which a finger can be inserted. Accordingly, the tab 29 can be denoted as a pull tab. The tab 29 is connected with the main part of the cap 9 through a weakening line 31.

When inserting a finger in the pull eye 30, it is possible to remove the tab 29.

Accordingly, this cap may be removed without the use of a screw driver.

Figure 17:
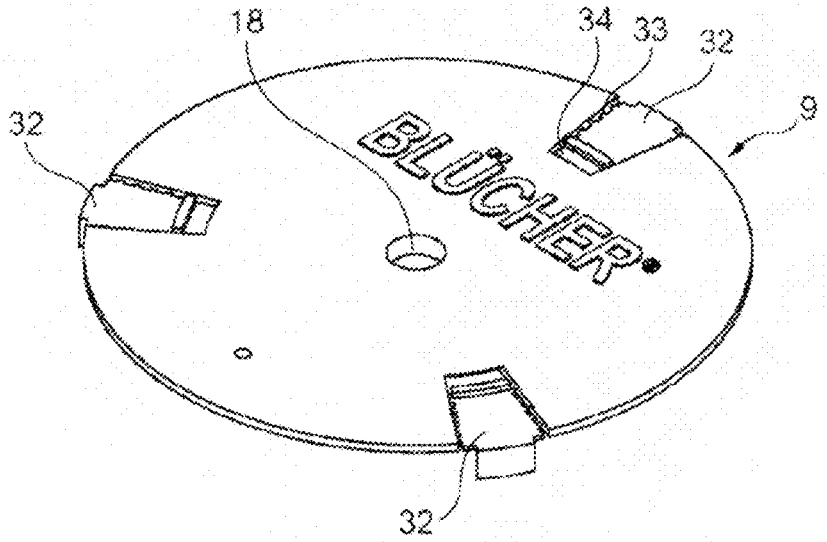

FIG. 17 illustrates a cap 9 being provided with tabs 32. Tabs 32 are connected with the main part of cap 9 through a weakening line 33 which leaves an opening 34 between the tab 32 and the main part of the cap. The opening 34 can be used for inserting a screw driver.

Figure 18:
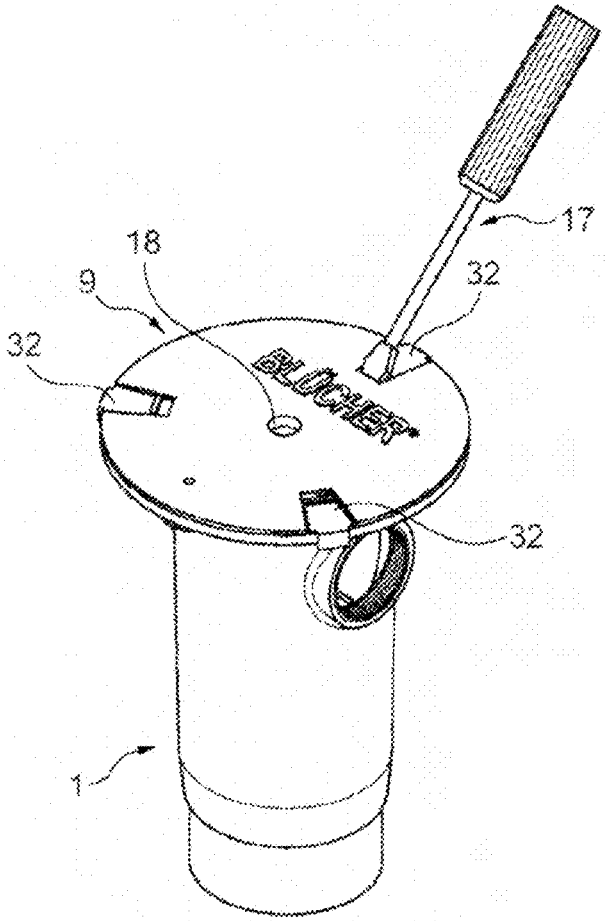
FIG. 18 corresponds to FIG. 9 and including a screw driver, operative to remove the cap of FIG. 17 from the drain of FIGS. 1 and 2.
Figure 19:
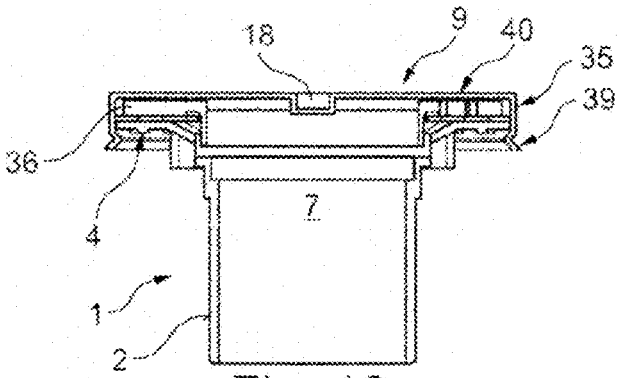
FIGS. 19-21 illustrate a further embodiment of the cap and drain according to the present disclosure.
Figure 20:
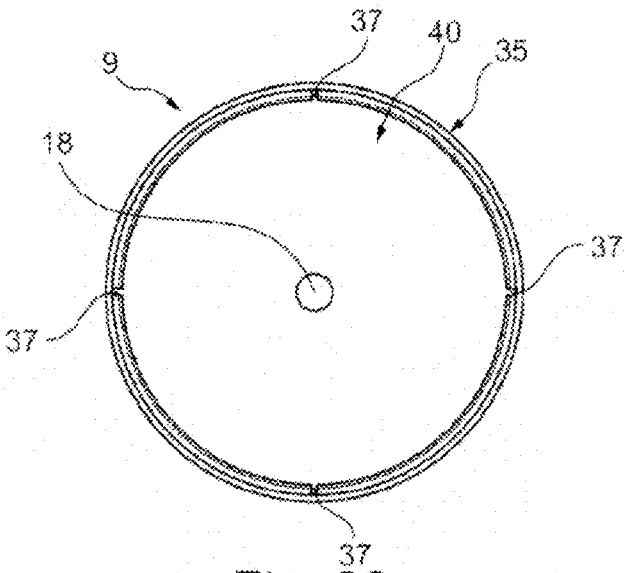
Figure 21:
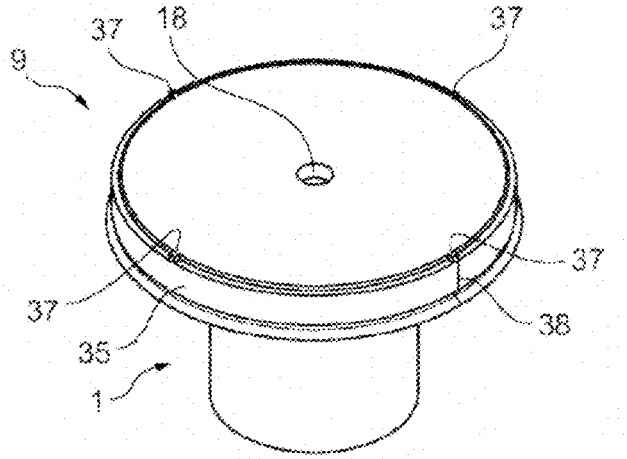

FIG. 18 illustrates the embodiment of FIG. 17 in which the screw driver 17 is inserted in the opening 34 in order to remove the tab 32 from the remainder of the cap. FIGS. 19-21 illustrate a further embodiment of a cap and a drain according to the present disclosure.

In the cross section in FIG. 19, the cap 9 is provided with a circular part 40 and a circumferential wall 35 connected with the circular part 40 of the cap 9.

The circumferential wall 35 has at a distal end a narrow portion 39 which has a diameter which is smaller than the diameter of the circumferential wall arranged close to the circular part 40. Hereby the narrow portion 39 can enter into engagement under the flange 4. In the embodiment illustrated, a clamping membrane 36 is arranged between the flange 4 and the circular part of the cap 9.

In the top view illustrated in FIG. 20, one can see that the cap is provided with weakenings in form of incisions 37 arranged with regular distance around the circumference where the circular part 40 is connected with the circumferential wall 35. The incisions make it easier that the circumferential wall 35 is divided into different portions which can easily be bent away when removing the cap 9 from the drain 1.

From the perspective view illustrated in FIG. 21, the circumferential wall 35 is provided with a weakening line 38. The weakening line 38 makes it easier to damage the circumferential wall 35 in order to remove the cap 9 from the drain 1.

Figure 4:
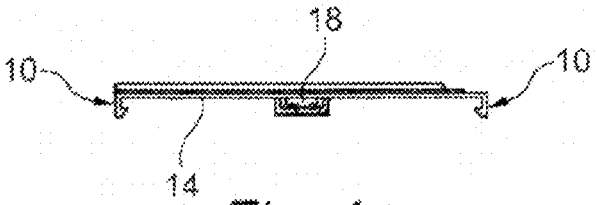
FIG. 4 shows a side view of the cap of FIG. 3.
Figure 5:
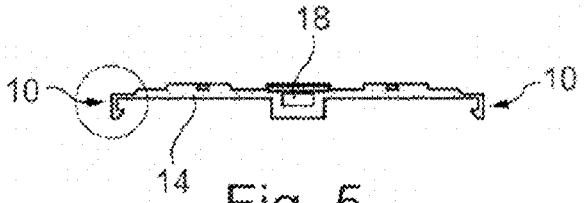
FIG. 5 shows a cross section along axis V-V in FIG. 3.

In the above embodiments the tabs provided in the cap 9 will have the form corresponding to the locking tabs 10 disclosed in FIG. 4-6. However, other embodiments for locking tabs are possible if they ensure a secure engagement with the drain 1 during installation.

Figure 22A:
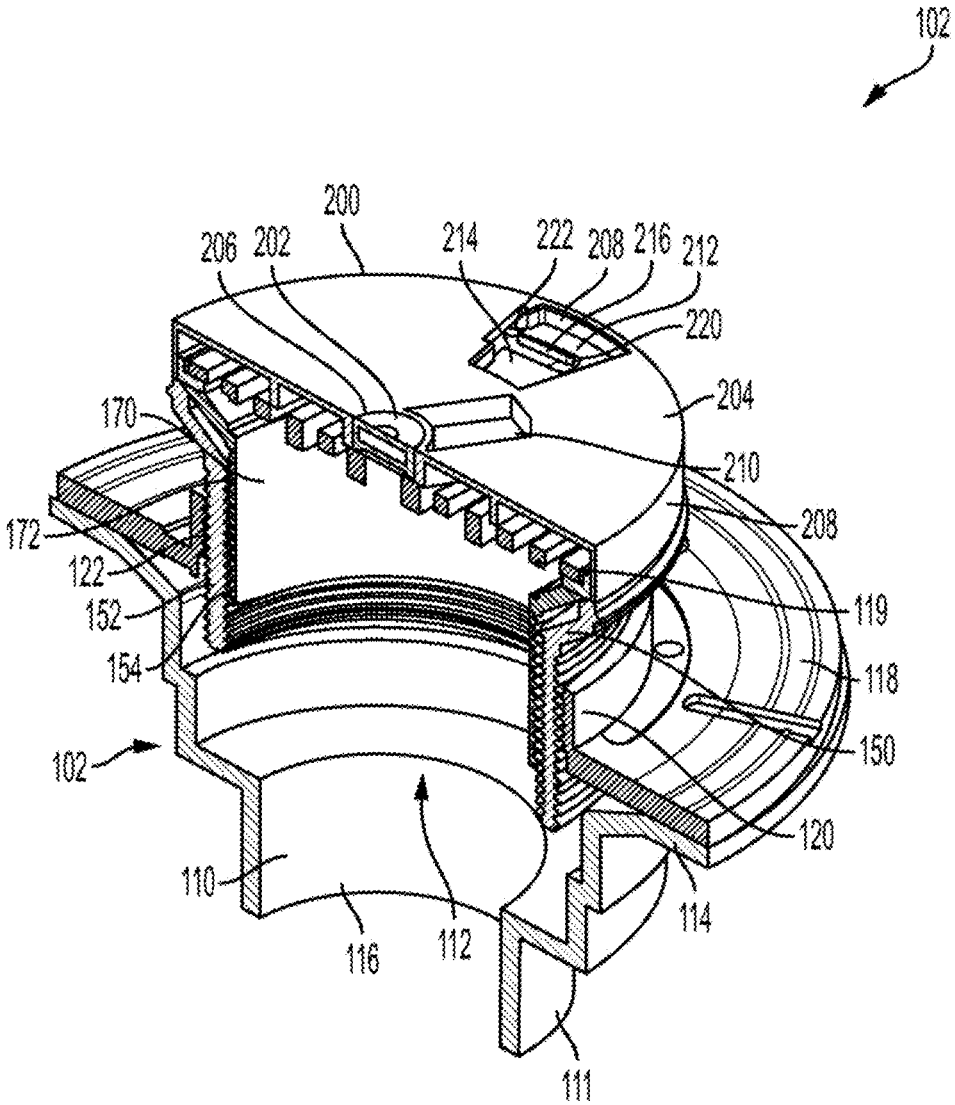
FIG. 22A illustrates a cross sectional perspective view of a further embodiment of the cap and drain, according to the present disclosure.
Figure 22B:
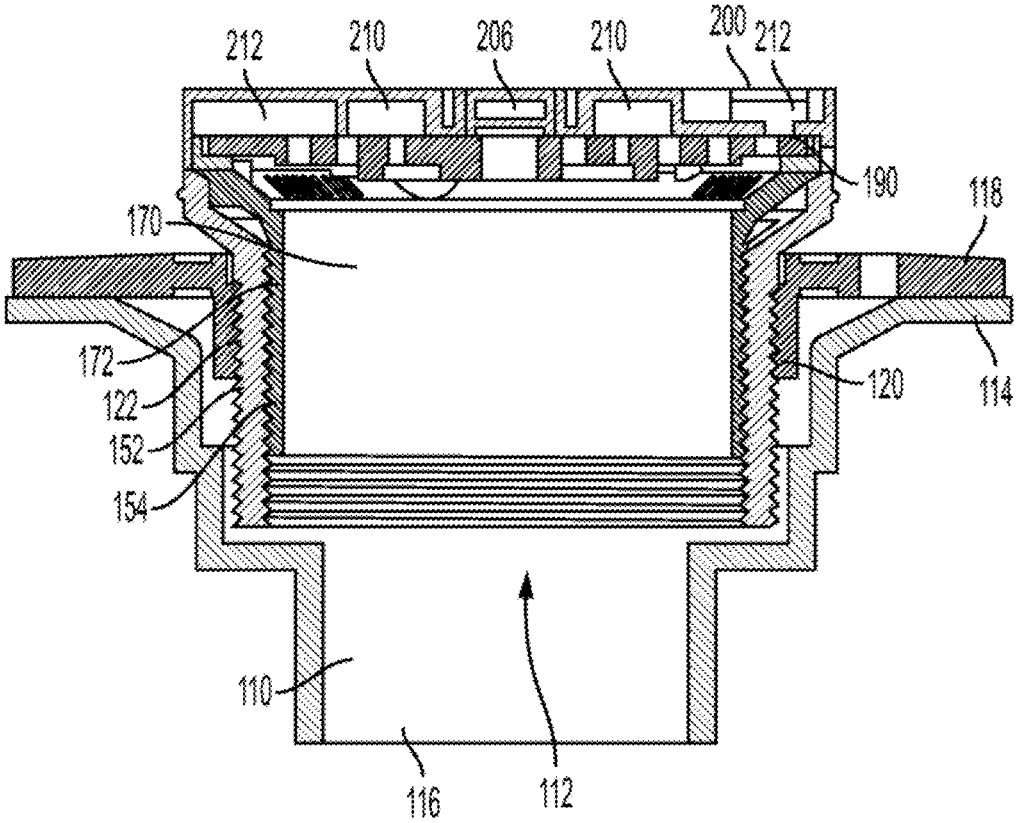
FIG. 22B illustrates a cross sectional view of a further embodiment of the cap and drain, according to the present disclosure with the height of the cap and drain minimized.
Figure 22C:
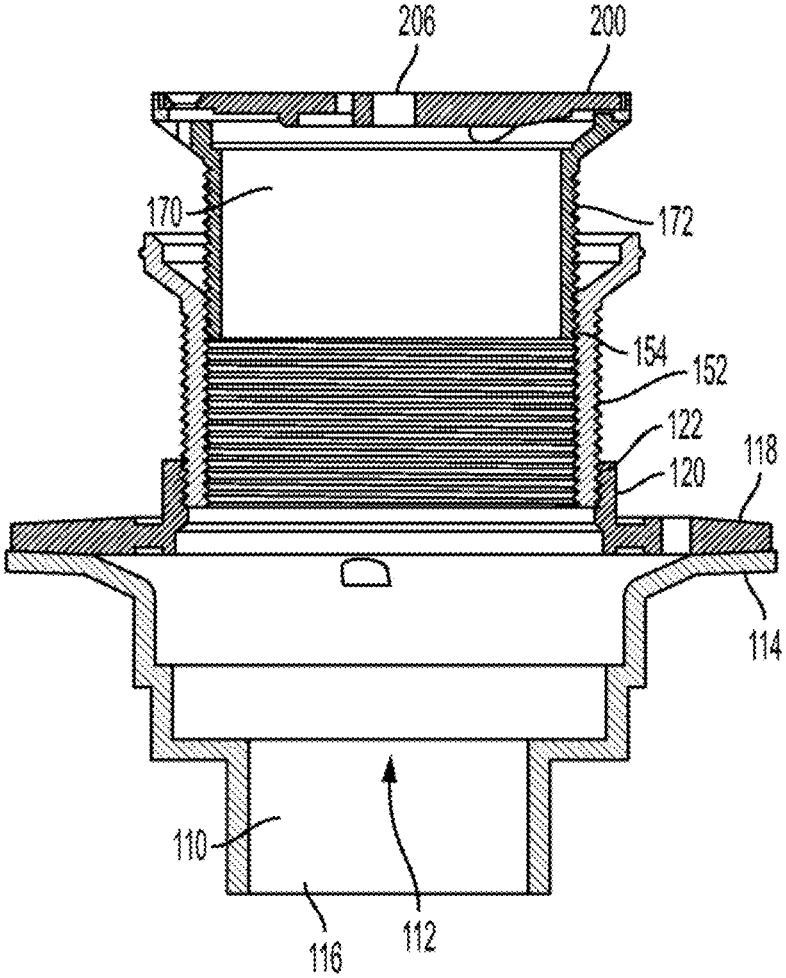
FIG. 22C illustrates a cross sectional view of a further embodiment of the cap and drain, according to the present disclosure with the height of the cap and drain maximized.

Referring now to FIG. 22A-22C, a further embodiment for a combination of a drain and cap or floor clean out assembly is illustrated, referred to herein as a floor cleanout assembly 102. The floor cleanout assembly 102 includes a drain body 110, and the drain body 110 connects with plumbing in order to facilitate the drainage of fluid from a floor or plane surface (not shown). The drain body 110 has a sidewall 11 tapering between an upper radial surface 114 and a lower outlet 116, forming a funnel shape. The floor cleanout assembly 102 defines a fluid passage 112 from a top grating cover 190 to the lower outlet 116.

The floor cleanout assembly 102 also includes a crown 118 mounted on the upper radial surface 114 of the drain body 110. The crown 118 and body 110 may be selectively coupled together (e.g., by screws) or permanently fixed together (e.g., welded). The crown 118 has an axial wall 120 extending the fluid passage 112 of the floor cleanout assembly 102. The crown 118 defines radially inward threads 122.

A housing 150 has radially outward threads 152 for coupling with the radially inward threads 122 of the crown 118 at a user-selected depth. The housing 150 also defines radially inward threads 154 to enable a shank 170 to threadably connect thereto. The shank 170 has radially outward threads 172 that interlock with the radially inward threads 154 of the housing 150 at a user-selected depth. The housing 150 and shank 170 further extend the fluid passage 112 to a varying depth based upon the insertion depths.

A circular grate or cleanout cover 190 couples to the shank 170. The cleanout cover 190 forms arcuate slots 192 (see FIG. 26) as an inlet to the fluid passage 112. The cap 200 also couples to the shank 170 to prevent debris from entering the fluid passage 112 and to provide a level means 202. The interaction and connectivity between the cap 200, housing 150, shank 170, and drain body 110 is explained in further detail below.

Figure 23:
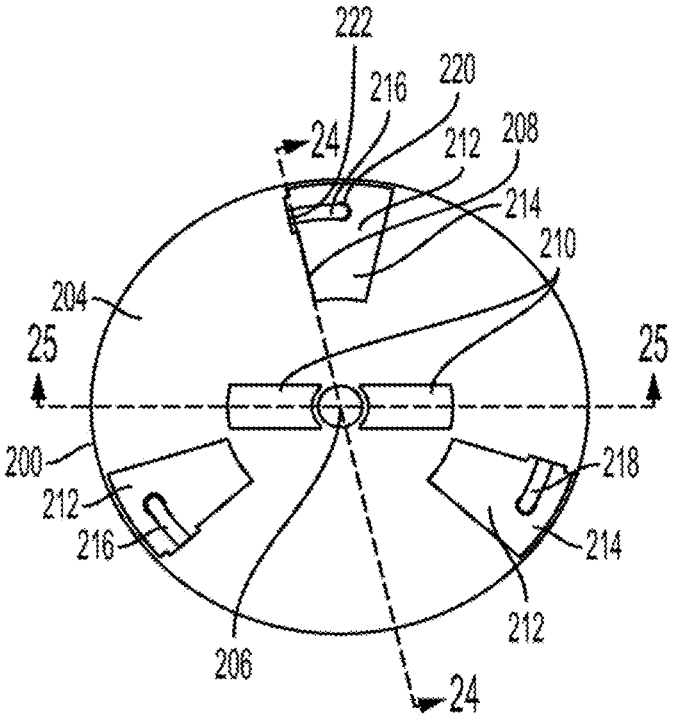
FIG. 23 illustrates a top plan view of the cap illustrated in FIG. 22.
Figure 25:
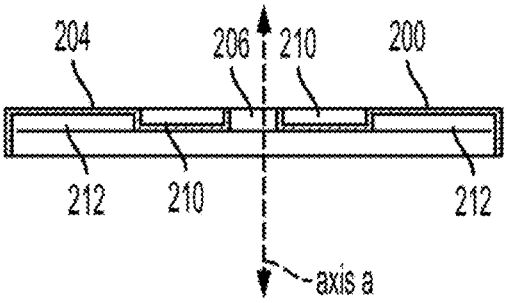
FIG. 25 illustrates another cross sectional view of the cap illustrated in FIG. 22 along line 25-25.

Referring now to FIGS. 23 and 25, a top view and a cross sectional view of the cap 200 in isolation is shown respectively. The cap 200 has a circular top surface 204 to match the shape of the cleanout cover 190. The top surface 204 defines a central hollow 206 for receiving level means 202. The top surface 204 also defines opposing notches 210. A common tool, such as pliers, can be inserted in the opposing notches 210 to facilitate rotation of the cap 200 about axis "a" of the floor cleanout assembly 102.

Figure 24:
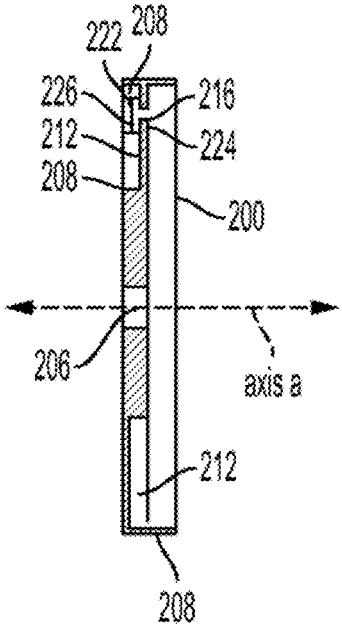
FIG. 24 illustrates a cross sectional view of the cap illustrated in FIG. 22 along line 24-24.

Referring now to FIGS. 23 and 24, a top and a cross sectional view of the cap 200 in isolation is shown respectively. The cap 200 defines three equally spaced recessed portions 212. Each recessed portion 212 is the same so the following description refers to a single recessed portion 212. The recessed portion 212 is confined by the one or more side walls 208 which depend from the top surface 204 of the cap 200. The recessed portion 212 also has a bottom portion 214 that defines a slit 216.

The slit 216 includes an arcuate portion 218, having curvature similar to a circumference of the cap 200. The slit 216 has a tail end 220 that may be chamfered for allowing a screw to sit therein. The slit 216 also includes an enlarged end 222 in the side wall 208 of the recessed portion 212. The enlarged end 222 can have any profile or shape to allow the screw captured in the slit 216 to be easily removed from the slit 216 by clockwise rotation of the cap 200. As shown for example, the enlarged end 222 has a lower neck portion 224 that opens to a rectangular top portion 226. Using the opposing notches 210 and a tool or simply by grabbing the cap 200, the cap 200 can be rotated to selectively allow the screw to freely pass through the enlarged end 222. As such, the cap 200 can be removed or installed without removing the screw.

Figure 26:
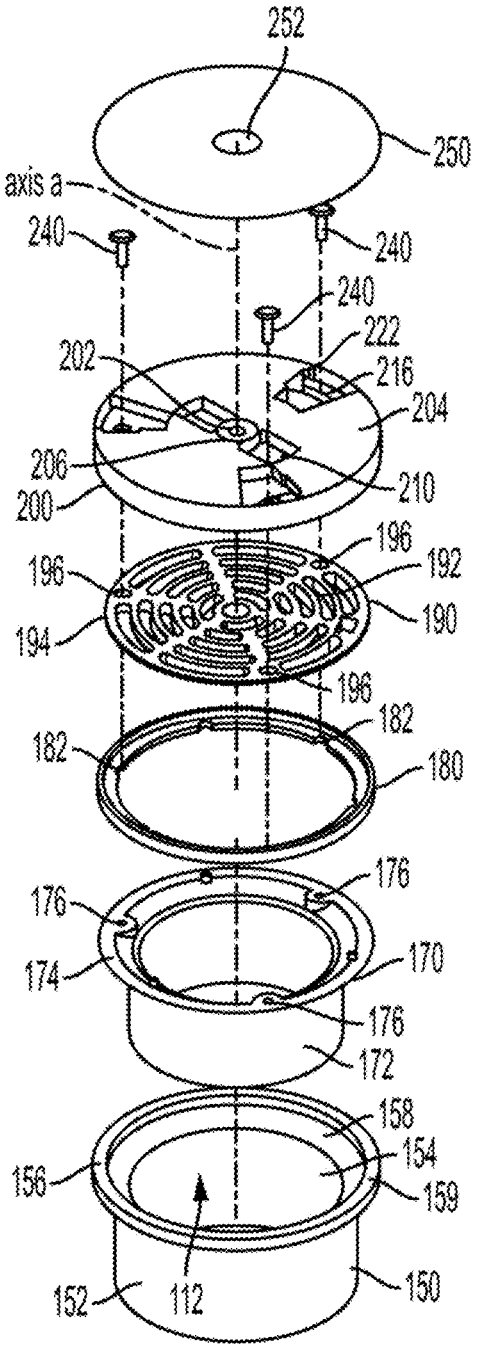
FIG. 26 illustrates an exploded view of the cap and the drain illustrated in FIG. 22.

Referring now to FIG. 26, an exploded view of the floor cleanout assembly 102 of FIG. 22-25 is shown. The drain body 110, the crown 118 and some threaded surfaces seen in FIG. 22 are omitted for clarity. The housing 150 is tubular in shape, forming a portion of the fluid passage 112, to facilitate the flow of fluid along axis "a". The housing 150 defines radially outward threads 152 and radially inward threads 154. The threads 150, 154 are optional as other features may be utilized to couple the housing 150 to the body 110. The radially outward threads 150 advantageously allow the user to screw the housing 150 into the body 110 at various depths to set a first height of the floor cleanout assembly 102. The housing 150 has an upper axial ridge 156 with a lower angled portion 158 and an upper vertical portion 159.

The shank 170 is also tubular in shape, forming a portion of the fluid passage 112, and forming a similar funnel to facilitate the flow of fluid. The shank 170 defines the radially outward threads 172 for connection with the housing 150. The shank 170 includes an upper axial ridge 174. Because of the shape of the upper axial ridge 174, the shank 170 can be inserted into the housing 150 such that an under side (not distinctly shown) of the upper axial ridge 174 of the shank 170 can mate with the lower angled portion 158 of the upper axial ridge 156 of the housing 150. Again, the shank 170 threads into the housing 150 so that a user can vary an insertion depth.

The upper axial ridge 174 of the shank 170 defines three equally spaced screw holes 176. As will be discussed in further detail below, several elements of the floor cleanout assembly 102 are screwed to the shank 170 using the screw holes 176. In short, the shank 170 supports the cap 200, cleanout cover 190, and strainer ring 180.

The strainer ring 180 is situated directly on the ridge 174 of the shank 170. The strainer ring 180 can house the cleanout cover 190 by enclosing an outer periphery 194 of the cleanout cover 190. The strainer ring 180 has a plurality of strainer ring screw notches 182 for passage of screws 240.

The cleanout cover 190 defines a plurality of arcuate slots 192, which are concentrically arranged. The slots 192 serve to tilter objects from fluid flowing through the cover 190 into the floor cleanout assembly 102. The cover 190 also defines three screw holes 196. As noted above, the cap 200 includes slits 216 so that when the cap 200 is on the cover 190, screws 240 can pass through the slits 216, the screw holes 196, and the notches 182 to thread into the screw holes 176 of the shank 170.

Once the screws 240 are tightened, a label protector 250 can be secured to the cap 200. The protector 250 has a central hole 252 for viewing the level means 202. The protector 250 can be glued or otherwise attached to the cap 200. The protector 250 is preferably frangible, such as a thin plastic sheet, so that when removal is desired, the protector 520 can be easily and quickly peeled and/or broken off. An informational sheet (not shown) can also be applied to the protector to include assembly and/or installation instructions, advertising information and the like. The floor cleanout assembly 102 is preferably sold fully assembled.

Referring still to FIGS. 22-26, for installation, the floor cleanout assembly 102 mounts to plumbing (not shown). For example, the outlet 116 may simply be sealed on to an upstanding pipe. The housing 150 can be axially adjusted along axis "a" relative to the drain body 110, prior to pouring concrete/subfloor installation. The level means 202 can be used to confirm proper orientation and shims may be used as needed for leveling. During installation of the subfloor, the cap 200 and protector 250 prevent debris, concrete, and the like from entering the fluid passage 112.

After installation of the subfloor with the cover 190 approximate the proper level, the shank 170 can be axially adjusted along axis "a" relative to the housing 150 to set the cover 190 to the proper level for the finished flooring such as tile. Thus, the floor cleanout assembly 102 has two axial adjustments, a first to set an initial length and a second to set a final, finished length as needed. The axial adjustment of both the housing 150 and shank 170 is enabled by the threading disposed thereon as mentioned prior, or alternatively by notches and protrusions, or a like adjustment method.

Again, while the finished floor is being created, the cap 200 and protector 250 prevent debris from entering the fluid passage 112. The label protector 250 can thereafter be removed to expose the top surface 204 of the cap 200. By loosening the screws 240 (if not already loose), a tool can be used in the notches to rotate the cap 200 clockwise so that the screws 240 pass through the respective enlarged ends 222. So oriented, the cap 200 can quickly and easily be released from the floor cleanout assembly 102. Of note, the screws 240 are not removed and remain in the floor cleanout assembly 102. Thus, the cover 190 remains in position and is simply and quickly fixed there by simply tightening down the screws 240 to complete the installation.

Figure 27:
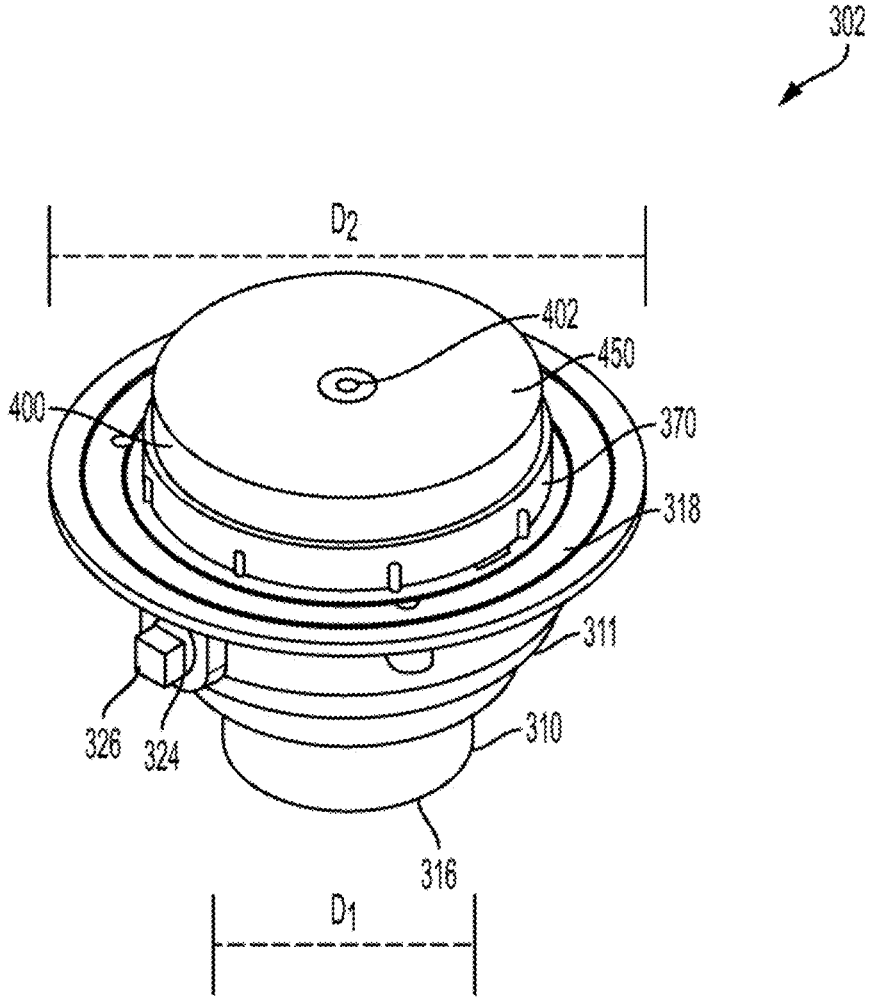
FIG. 27 shows a perspective view of a floor cleanout assembly ready for installation onto a plumbing fixture.

Referring now to FIG. 27, a floor cleanout assembly 302 is shown in accordance with another aspect of the present disclosure. As will be appreciated by those of ordinary skill in the pertinent art, the floor cleanout assembly 302 utilizes similar principles to the floor cleanout assembly 102 described above. Accordingly, like reference numerals preceded by numerals "3" and "4" instead of the numerals "I" and "2" are used to indicate like elements.

The floor cleanout assembly 302 is preferably sold fully assembled to save installation time. The floor cleanout assembly 302 can be unwrapped from its packaging and directly connected to a plumbing fixture without further assembly. In normal installation, the floor cleanout assembly 302 provides pre- and post-concrete pour axial adjustment relative to a floor. That is, the floor cleanout assembly 302 can be axially adjusted before and after the pumping and spreading of concrete proximate the assembly 302 and plumbing while being protected from loose debris by the cap 420 and protector 450. Once installed, the floor cleanout assembly 302 operates to drain fluid from an environment. The floor cleanout assembly 302 is equally applicable to roofing and other fluid drainage scenarios. For brevity, the following description is directed to the differences of the floor cleanout assembly 302.

Figure 28:
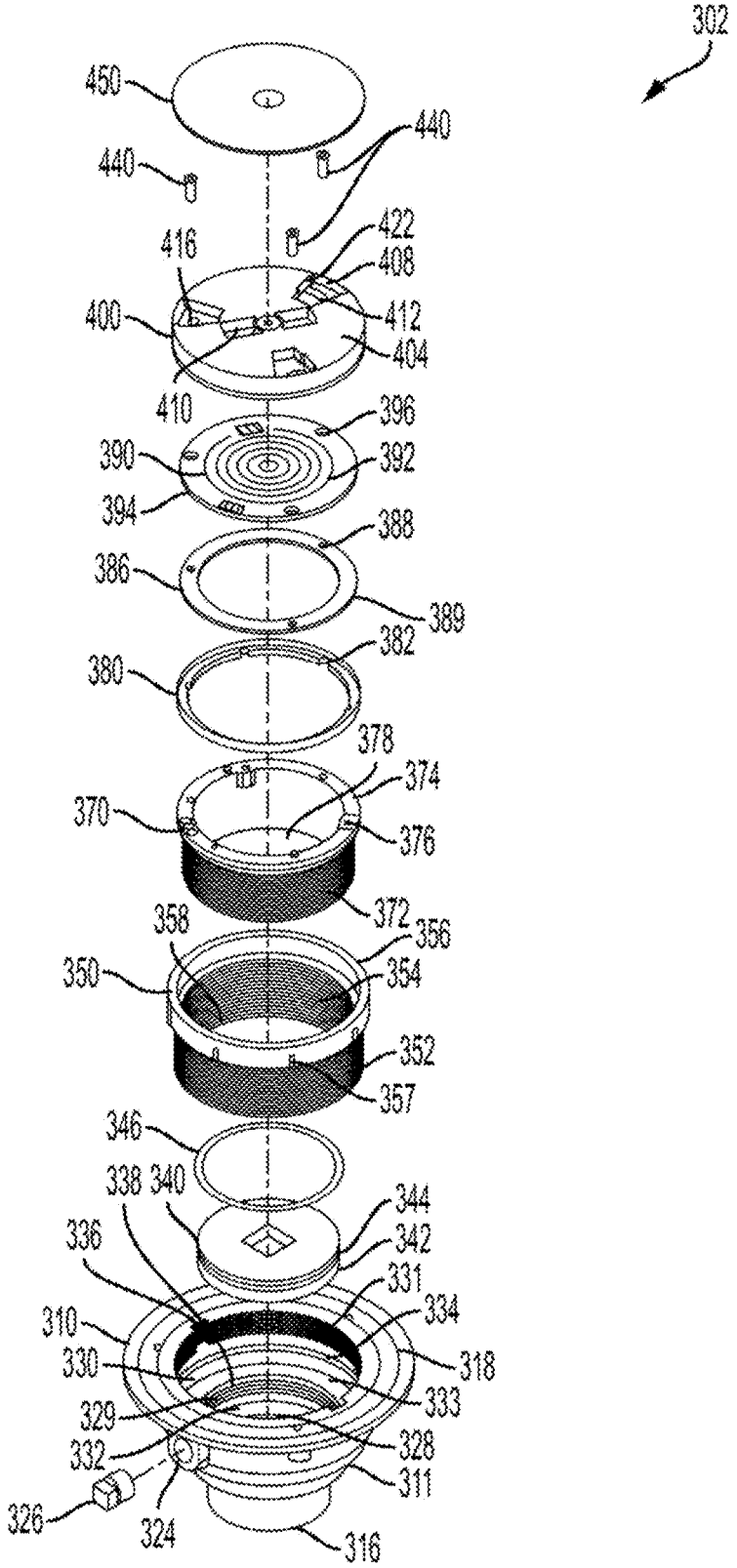
FIG. 28 shows an exploded view of the floor cleanout assembly of FIG. 27.

Referring now to FIG. 28, an exploded view of the floor cleanout assembly 302 is shown. The floor cleanout assembly 302 includes a housing 350 threaded to the drain body 310, and a shank 370 threaded to the housing 350.

The floor cleanout assembly 302 includes a drain body 310. Fluid funnels through the drain body 310 beginning at inlets 392 formed in a cover 390 (see FIG. 28), protected underneath the cap 400. The fluid exits the drain body 310 at a lower outlet 316. The drain body 310 connects with a plumbing fixture at the lower outlet 316 to facilitate the fluid drainage. The floor cleanout assembly 302 has a first diameter at the lower outlet 316. The first diameter roughly corresponds to a diameter of the plumbing fixture such that the lower outlet 316 can either fit within the plumbing fixture or around an outer circumference of the plumbing fixture.

The sidewall 311 of the drain body 310 is cylindrical and tapers either step-wise, gradually, or a combination of both between the lower outlet 316 and an upper radial surface 318. The upper radial surface 318 has a second diameter which is larger than the first diameter.

The drain body 310 includes a trap primer bore 324 disposed in the drain body 310 side wall 311. The trap primer bore 324 can optionally connect to a trap primer (not distinctly shown) to prevent the floor cleanout assembly 302 from losing a water seal by evaporation. Maintaining the water seal prevents backflow of sewer gas into buildings or rooms where the floor cleanout assembly 302 is installed. The trap primer bore 324 can be plugged with a bore plug 326 when a trap primer is not connected to the floor cleanout assembly 302.

The drain body 310 of FIG. 28 also includes a primary, secondary, tertiary, and quaternary inner circumferential surface 328, 329, 330, 331, separated by a first, second, and third shelf 332, 333, 334 respectively. The primary inner circumferential surface 328 is positioned proximate to the lower outlet 316 and in fluid communication therewith. In this regard, the primary inner circumferential surface 328 defines the lower outlet 316 and has the same or similar diameter to the first diameter $D_1$ as the lower outlet 316.

The first shelf 332 is a radial surface that provides a lateral transition between the primary inner circumferential surface 328 of the drain body 310 to the secondary inner circumferential surface 329. In this regard, the first shelf 332 can provide support for the shank 370 and/or the housing 350.

The second shelf 333, which is also a radial surface, provides a lateral transition between the secondary inner circumferential surface 329 of the drain body 310 to the tertiary inner circumferential surface 330. In this regard, the second shelf 333 can provide support for the shank 370 or the housing 350. Accordingly, the first or second shelf 332, 333 may act as a travel stop for inserting the shank 370 and the housing 350 into the drain body 310. Alternatively, the housing 350 may have an upper ridge 356 and the shank 370 may have a lip 374 that act as insertion stops.

A third shelf 334, including a radial surface, provides a lateral transition between the tertiary inner circumferential surface 330 and a quaternary inner circumferential surface 331. The quaternary inner circumferential surface includes a notch 336 to restrain the housing 350 as will be described in more detail below.

The first, second, or third shelf 332, 333, 334 is able to support a cleanout plug 340. The cleanout plug 340 prevents the backflow of liquid when the floor cleanout assembly 302 is installed. The cleanout plug 340 external sidewall 342 may define radially outward threads circumferentially disposed around the cleanout plug 340 to couple to threads defined by the primary, secondary, tertiary, or quaternary inner circumferential surface 328, 329, 330, 331. The cleanout plug 340 defines a groove 344 for a cleanout plug o-ring 346 to seat in. The cleanout plug o-ring 346 is compressible and forms a fluid seal between the interface of the cleanout plug 340 and the housing 350.

The housing 350 defines housing radially outward threads 352 circumferentially disposed around the housing 350. Opposite the housing radially outward threads 352 are housing radially inward threads 354. The housing 350 inserts into an opening 338 of the drain body 310 and rotates such that the housing radially outward threads 352 are coupled and interlocked with threads defined by the primary, secondary, or tertiary inner circumferential surface 328, 329, 330, 331. By threading, the housing 350 can be selectively adjusted axially with respect to the drain body 310.

The housing 350 has an upper axial ridge 356. The upper axial ridge 356 defines axial housing ribs 357 projecting outwards radially. The ribs 357 facilitate gripping the housing 350 by hand or with a tool for rotational movement.

Still referring to FIG. 28, the shank 370 has a circular throughbore 378. The shank 370 includes shank radially outward threads 372 for threading insertion into the opening 358 of the housing 350. Thus, the shank 370 can also be selectively adjusted axially out of and into the housing 350 by rotation. The shank 370 includes a lip 370 with screw holes 376. The shank 370 supports the cap 400, cleanout cover 390, cleanout cover gasket 386, and strainer ring 380.

Situated on the lip 370 of the shank 370 is the strainer ring 380. The strainer ring 380 can house the cleanout cover gasket 386 by enclosing an outer periphery 389 of the cleanout cover gasket 386. The strainer ring 380 has strainer ring screw notches 382 to receive a portion of screws 440 driven through the cleanout cover gasket 386 screw holes 388.

The cleanout cover gasket 386 is a seal between the shank 370 and a cleanout cover 390. The gasket 386 prevents leakage of liquid traveling through the floor cleanout assembly 302, specifically between the shank 370 and a cleanout cover 390. The cleanout cover 390 includes inlets 392 for filtering objects from fluid entering the floor cleanout assembly 302. The cleanout cover 390 has screw holes 396 to bolt the cleanout cover 390 to the shank 370.

The floor cleanout assembly 302 includes a cap 400, similar to as described with reference to FIGS. 23-25. Further to the description of the cap 400 provided above, the cap 400 includes a top surface 404 defining a recessed portion 412. Each recessed portion 412 forms a sidewall 408 and the sidewall 408 defines a slit 416 in a surface therein. The slit 416 includes an arcuate portion extending between an end and a tail (not distinctly shown).

The cap 400 is secured by the screws 440 to the shank 370. When the screws 440 are driven through the cap 400, the screws 440 are captured in the respective slits 416. The cap 400 can be rotated to selectively allow the screws 440 to freely pass through out of the slits 416 for removal of the cap 400 without removing the screws 440.

A protector 450 is affixed to the cap 400 by adhesive, such as glue. The protector 450 prevents debris from collecting on the cap 400 during installation and otherwise. The protector 450 provides indicia related to instructions, trademarks and like information.

Figure 29:
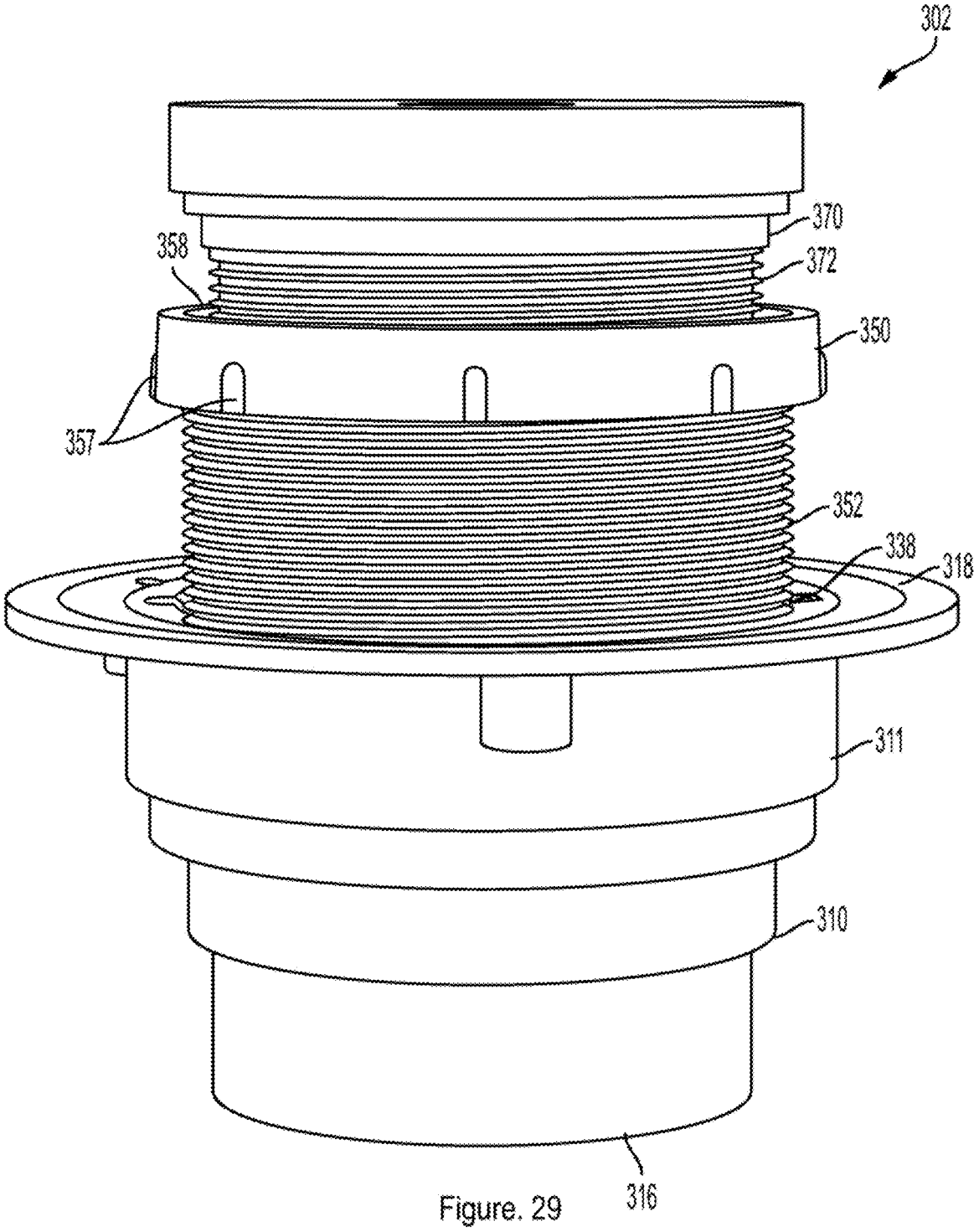
FIG. 29 shows a side view of the floor cleanout assembly of FIG. 27, particularly illustrating the telescoping of the housing relative to the drain body and the shank relative to the housing.

Referring now to FIG. 29, a perspective view of the floor cleanout assembly 302 of FIG. 28 partially extended is shown. The drain body 310 receives the housing 350 in the opening 338, opposite the lower outlet 316. The housing 350 couples and interlocks with the drain body 310 by the housing radially outward threads 352 and threads located on the primary, secondary, or tertiary inner circumferential surface (not distinctly shown) of the drain body 310. An opening 358 defined by the housing 350 is aligned with the opening 338 of the drain body 310 such that fluid can flow through the housing 350 and into the drain body 310.

Similarly, the housing 350 receives the shank 370 in the opening 358. The shank 370 couples and interlocks with the housing 350 by the shank radially outward threads 372 and the housing radially inward threads 354. In this regard, the throughbore (not distinctly shown) of the shank 370, as mentioned with reference to FIG. 28, is aligned with the opening 310 of the housing 350, and therefore the opening 338 of the drain body 310.

Referring to FIGS. 28 and 29, for installation, before creation of a sub-floor around the floor cleanout assembly 302, the protector 450 can be set to be flush with the sub-floor. Preferably, the axial travel of the housing 350 is sufficient to set the proper height and the shank 370 is fully inserted into the housing 350, but such is not required. The floor cleanout assembly 302 is installed by aligning the lower outlet 316 of the drain body 310 with plumbing, such as a pipe (not distinctly shown). The bubble level 402 can be analyzed to ensure that the floor cleanout assembly 302 is axially aligned with the pipe. Shims (not distinctly shown) are preferably provided so that orientation of the cover 390 to level can be easily adjusted with the shims. Once the cap 400 and protector 450 are in the desired height and level position, the sub-floor can be created. For example, concrete to form the sub-floor can be poured and leveled across the protector 450 to be even therewith.

After the sub-floor is created (e.g., the concrete sets), the protector 450 can be removed by cracking any concrete that may be thereon. The protector 450 may also break apart for removal or simply peeled off to access the cap 400. The notches 410 of the cap 400 can be utilized to rotate the cap 400 and, in turn, the shank 370 for setting a second height relative to the finished floor.

Once the screws 440 are loosened, the cap 400 can then be rotated relative to the shank 370 and cover 390 for removal. As noted above, the screws 440 freely pass through the enlarged end 422 for removal of the cap 400 without removing the screws 440. After removal of the cap 400, the screws 440 are simply tightened. Thereafter, the cleanout cover 390 and the shank 370 are exposed and may be further adjusted if needed. In one embodiment, the shims are simply arcuate solid shapes to fit under a portion of the cover 390 by loosening the screws 440 after removal of the cap 400, accomplishing levelness, and retightening the screws 440.

The shank 370 can then be axially adjusted via rotation of the shank 370 relative to the housing 350 by virtue of the coupling and interlocking of the shank radially outward threads 372 and the housing radially inward threads 354. As such, the shank 370 can axially extend out of the housing 350 or retract therein via a telescoping motion. Once set to a desired level, typically in plane with the finished floor, the floor cleanout assembly 302 has a second height.

Figure 30:
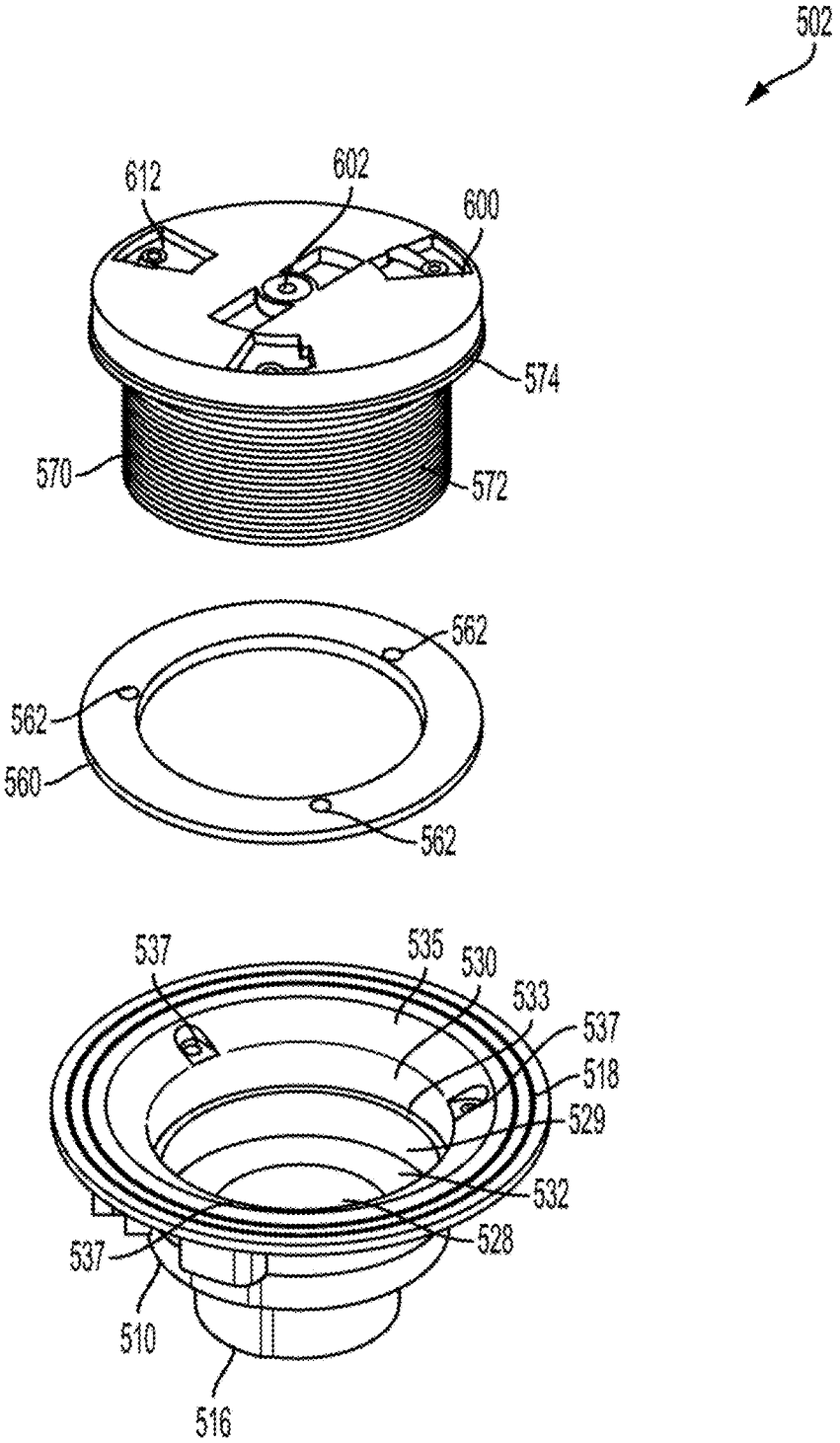
FIG. 30 shows an exploded view of a second embodiment of the floor cleanout assembly of FIG. 27.

Referring now to FIG. 30, a floor cleanout assembly 502 is shown in accordance with an aspect of the present disclosure. As will be appreciated by those of ordinary skill in the pertinent art, the floor cleanout assembly 502 utilizes similar principles to the floor cleanout assemblies 102, 302 described above. Accordingly, like reference numerals preceded by numerals "5" and "6" instead of the numerals "1", "2", "3", and "4" are used to indicate like elements.

The drain body 510 in FIG. 30 differs from the drain body 310 as described with reference to FIG. 28 in that the drain body 310 of FIG. 28 includes a primary, secondary, tertiary, and quaternary inner circumferential surface 328, 329, 330, 331, separated by a first, second, and third shelves 332, 333, 334 respectively, whereas the drain body 510 of FIG. 30 only includes a primary, secondary, and tertiary inner circumferential surface 528, 529, 530, separated by a first and second shelf 532, 533 respectively. At an opposite extremity to the second shelf 533, the tertiary inner circumferential surface 530 also pans laterally outward along a transition surface 535 into the upper radial surface 518.

The transition surface 535 defines a gradient for fluid to travel into the drain body 510. The transition surface 535 defines three equally spaced screw holes 537, to seat the crown (not distinctly shown) as mentioned prior, or to fasten a membrane clamp 560 thereto using holes 562 with screws (not shown). The membrane clamp 560 acts to evenly distribute a load across the transition surface 535 and the upper radial surface 518 of the drain body 510 when affixed to the housing (not distinctly shown) or shank 570 of the floor drain and cleanout assembly 502.

The shank 570 defines radially outward threads 572 and is connected to the drain body 510 by inter-coupling of the radially outward threads 572 to threads located on the primary, secondary, or tertiary inner circumferential surface 528, 529, 530. In this regard, the shank 570 can be axially adjusted or disassociated from the drain body 510 by rotating the shank 570 relative to the drain body 510. The shank 570 may also be supported by the first or second shelf 532, 533.

The shank 570 has a shank lip 574 that conforms to the gradient of the transition surface 535 of the drain body 510, enabling mating contact there between. The shank 570 supports a cap 600 of the floor cleanout assembly 202. The cap 600 includes a bubble level 602, a recessed portion 612, and a slit (not distinctly shown) as described with reference to FIGS. 23-28.

In one embodiment, the floor cleanout assemblies are fabricated from PVC or cast iron. PVC may couple to pipes with a solvent weld and cast iron with neoprene or a gasket for push-on scaling and the like. Common sizes for the outlet of the floor cleanout assemblies are 2, 3, 4 and 6 inch diameters with inlets of 4, 5, 6, 7 and 8 inch diameters. In one embodiment, the housing provides approximately up to 1.5 inches of initial axial extension and the shank provides approximately up to 1.0 inches of secondary axial extension. For example, a floor cleanout assembly may have a most compact axial length of about 5.5 inches as shown in FIG. 22B and a maximum axial length of about 8.0 inches as shown in FIG. 22C.

It should be appreciated that the subject technology can be implemented and utilized in numerous ways, including without limitation as a process, an apparatus, a system, a device, a method for applications now known and later developed. These and other unique features of the system disclosed herein will become more readily apparent from the following description and the accompanying drawings.

What is claimed is:

1. A floor cleanout assembly comprising:

a drain assembly having:

a drain body defining a hollow interior having an inlet end and an outlet end;

a cylindrical housing having both radially outward threads and radially inward threads;

a cylindrical shank having a throughbore defining an inlet, and at least one screw hole, the cylindrical shank having radially outward threads for threadable engagement with the radially inward threads of the cylindrical housing at a user-selected depth; and a grating cover coupled to the cylindrical shank by at least one screw that is threadably received in the at least one screw hole;

a cap covering and secured to the grating cover by the at least one screw threadably engaged with the at least one screw hole, wherein the cap defines at least one slit having an arcuate portion and an enlarged end in a side wall of a recessed portion of a top surface of the cap;

wherein the at least one screw is captured in the arcuate portion and the cap can be rotated to selectively allow the at least one screw to freely pass through the enlarged end for removal of the cap without removing the at least one screw.

2. The floor cleanout assembly of claim 1, wherein the cap includes opposing notches for receiving a tool to rotate the cap.

3. The floor cleanout assembly of claim 1, wherein the cylindrical shank includes at least three screw holes.

4. The floor cleanout assembly of claim 1 further comprising:

a strainer ring disposed between the grating cover and the cylindrical shank.

5. The floor cleanout assembly of claim 1 further comprising:

a crown mounted on an upper radial surface of the drain body.

6. The floor cleanout assembly of claim 5, wherein the crown has radially inward threads capable of threadably engaging the radially outward threads of the housing.

7. The floor cleanout assembly of claim 6, wherein the crown and the drain body are permanently fixed together.

8. The floor cleanout assembly of claim 7, wherein the crown and the drain body are welded together.

9. The floor cleanout assembly of claim 1 further comprising:

a label protector secured to the cap.

10. The floor cleanout assembly of claim 1, wherein the cap includes a level.

* * * * *